US006522319B1

(12) United States Patent
Yamazaki

(10) Patent No.: US 6,522,319 B1
(45) Date of Patent: Feb. 18, 2003

(54) ELECTRO-OPTICAL DEVICE AND METHOD FOR DRIVING THE SAME, LIQUID CRYSTAL DEVICE AND METHOD FOR DRIVING THE SAME, CIRCUIT FOR DRIVING ELECTRO-OPTICAL DEVICE, AND ELECTRONIC DEVICE

(75) Inventor: Suguru Yamazaki, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/402,625

(22) PCT Filed: Feb. 8, 1999

(86) PCT No.: PCT/JP99/00552

§ 371 (c)(1),
(2), (4) Date: Oct. 7, 1999

(87) PCT Pub. No.: WO99/40561

PCT Pub. Date: Aug. 12, 1999

(30) Foreign Application Priority Data

Feb. 9, 1998 (JP) ..... 10-027665
Oct. 13, 1998 (JP) ..... 10-291211

(51) Int. Cl.[7] ..... G09G 3/36
(52) U.S. Cl. ..... 345/103; 345/94
(58) Field of Search ..... 345/100, 98, 103, 345/94

(56) References Cited

U.S. PATENT DOCUMENTS

| | | | | |
|---|---|---|---|---|
| 4,378,557 A | | 3/1983 | Murata | 340/805 |
| 4,845,473 A | * | 7/1989 | Matsuhashi et al. | 340/784 |
| 5,805,121 A | | 9/1998 | Burgan et al. | 345/51 |
| 5,867,140 A | | 2/1999 | Rader | 345/98 |

FOREIGN PATENT DOCUMENTS

| | | | | |
|---|---|---|---|---|
| EP | 0811866 | * | 6/1997 | G09G/3/36 |
| EP | 1134721 | * | 2/2001 | G09G/3/36 |
| JP | A-4-115288 | | 4/1992 | G09G/3/20 |
| JP | 6-95621 | | 4/1994 | G09G/3/36 |
| JP | A-7-64512 | | 3/1995 | G09G/3/36 |
| JP | 7-281632 | | 10/1995 | G09G/3/18 |
| JP | A-10-187106 | | 7/1998 | G09G/3/36 |
| JP | A-10-214063 | | 8/1998 | G09G/3/36 |
| WO | WO96/21880 | | 7/1996 | G02F/1/133 |

* cited by examiner

*Primary Examiner*—Amare Mengistu
(74) *Attorney, Agent, or Firm*—Oliff & Berridge, PLC

(57) ABSTRACT

In an electrooptical apparatus having a function allowing part of a display screen to be in a display state and allowing the other to be in a non-display state, for a non-display region, application voltages for scanning electrodes are fixed at non-selection voltages, and application voltages for signal electrodes are fixed at voltages similar to the case of a full-screen ON-display or a full-screen OFF-display at least in a predetermined period; therefore, power consumption in the partial display state can be reduced.

30 Claims, 20 Drawing Sheets

FIG. 4A $$\begin{array}{c} \\ f1\cdots\cdots \\ f2\cdots\cdots \\ f3\cdots\cdots \\ f4\cdots\cdots \end{array} \begin{array}{c} \begin{array}{cccc} Y_{4n+1} & Y_{4n+2} & Y_{4n+3} & Y_{4n+4} \end{array} \\ \begin{pmatrix} 1 & -1 & 1 & 1 \\ 1 & 1 & -1 & 1 \\ -1 & 1 & 1 & 1 \\ 1 & 1 & 1 & -1 \end{pmatrix} \end{array}$$

FIG. 4B $$\begin{array}{c} Y_{4n+1}\cdots\cdots \\ Y_{4n+2}\cdots\cdots \\ Y_{4n+3}\cdots\cdots \\ Y_{4n+4}\cdots\cdots \end{array} \begin{pmatrix} d1 \\ d2 \\ d3 \\ d4 \end{pmatrix}$$

FIG. 4C $$\begin{array}{c} f1\cdots\cdots \\ f2\cdots\cdots \\ f3\cdots\cdots \\ f4\cdots\cdots \end{array} \begin{pmatrix} 1 & -1 & 1 & 1 \\ 1 & 1 & -1 & 1 \\ -1 & 1 & 1 & 1 \\ 1 & 1 & 1 & -1 \end{pmatrix} \times \begin{pmatrix} d1 \\ d2 \\ d3 \\ d4 \end{pmatrix} = \begin{pmatrix} d1 - d2 + d3 + d4 \\ d1 + d2 - d3 + d4 \\ -d1 + d2 + d3 + d4 \\ d1 + d2 + d3 - d4 \end{pmatrix}$$

ELECTRO-OPTICAL DEVICE AND METHOD FOR DRIVING THE SAME, LIQUID CRYSTAL DEVICE AND METHOD FOR DRIVING THE SAME, CIRCUIT FOR DRIVING ELECTRO-OPTICAL DEVICE, AND ELECTRONIC DEVICE

BACKGROUND OF THE INVENTION

1. Field of the Invention

The present invention relates to an electrooptical apparatus having a function causing a part of a display screen to be in a display state and causing the other to be in a non-display state and a driving method therefor. Furthermore, the invention, using a liquid crystal display apparatus as the electrooptical apparatus, relates to the driving method for the liquid crystal display apparatus, which allows a partial display state without providing an incompatibility and with less power consumption, and it also relates to the liquid crystal display apparatus performing display operation according to the above. The present invention also relates to a driving circuit suitable for driving the electrooptical apparatus of the invention.

Furthermore, this invention relates to an electronic equipment to be used for the electrooptical apparatus and the display apparatus described above.

2. Description of Related Art

With display apparatuses being used for portable electronic equipments such as portable telephones, the number of display dots is increasing year by year so that increasing amounts of information can be displayed. Accordingly, power consumption by the display apparatus is also increasing. Generally, the portable type electronic equipment uses battery as a power source; therefore, reduced power consumption with the display apparatus is strongly demanded so that battery service life can be extended. That is why, a study has begun for development such that with a display apparatus having a larger number of the display dots, a full screen is displayed when it is necessary; however, in normal use, only a partial region of a display panel is allowed to be in a display state and the other is left in a non-display state so that power consumption can be reduced. Furthermore, in response to the demand for power-consumption reduction, as display apparatuses of portable type electronic equipment, liquid crystal display panels of a reflective type or a transflective type designed by placing importance on appearance in a reflection mode is used.

In conventional liquid crystal display apparatuses, they have, in most cases, a function allowing control of display/non-display operations on a full-screen basis; however, a display apparatus having a function that allows only part of a full screen to be in a display state and allows the other to be in a non-display state has not been realized to date. A method to realize a function that allows only partial lines of a liquid crystal display panel to be in a display state and the other to be in a non-display state has been proposed with Japanese Unexamined Patent Publication Nos. 6-95621 and 7-281632. Both of these two proposals disclose a method in which display duties are varied according to the case of a partial display and the case of a full-screen display so as to obtain driving voltages and bias ratios which are suitable to the individual duties.

The method proposed in Japanese Unexamined Patent Publication No. 6-95621 will be described below with reference to FIGS. 19 to 21. FIG. 19 is a block diagram showing an example of conventional liquid crystal display apparatuses. A block 51 represents a liquid crystal display panel (LCD panel) in which a substrate on which plural scanning electrodes are formed and a substrate on which plural signal electrodes are formed are arranged to oppose each other with a several-$\mu$m gap, and a liquid crystal is enclosed in the gap. By the liquid crystal at cross sections of the scanning electrodes arranged in the line direction and the signal electrodes arranged in the column direction, pixels (dots) are to be formed in a matrix. A block 52 represents a scanning-electrode driving circuit (Y driver) that drives the scanning electrodes, and a block 53 represents a signal-electrode driving circuit (X driver) that drives the signal electrodes. Plural voltage levels necessary for driving the liquid crystal are formed in a driving-voltage forming circuit represented by a block 54 and are applied to the liquid crystal display panel 51 through the X driver 53 and the Y driver 52. A block 57 represents a scanning control circuit that controls the number of the scanning electrodes to be scanned. A block 55 represents a controller that supplies signals necessary for these circuits, FRM denotes a frame start signal, CLY denotes a scanning-signal transfer clock, CLX denotes a data transfer clock, Data denotes display data, LP denotes a data latch signal, and PD denotes a partial display control signal. A block 56 represents a power source for the circuits described above.

In this conventional example, a case in which the partial display appears on the left-half screen and on the upper-half screen is described; however, hereinbelow, a description will be given of the latter case in which lines for the upper-half screen are arranged in the display state and lines for the lower-half are arranged in the non-display state. The number of the scanning electrodes is assumed to be 400. The controller 55 turns the partial display control signal PD to an H level to allow the lower-half screen to be in the display state. When the partial display control signal PD is at an L level, all the scanning electrodes are scanned at a 1/400 duty, by which the full-screen is turned to the display state. When the partial display control signal PD is at the H level, only the scanning electrodes for the upper-half screen are scanned at a 1/200 duty, by which the upper-half screen is turned to the display state and the remaining lower-half screen is turned to the non-display state. Switching to the 1/200 duty is performed by switching to the duplicated cycle of the scanning-signal transfer clock CLY to reduce the number of clocks in one frame period. A scanning-stopping manner for the scanning electrodes for the lower-half screen in the partial display state is not described in detail. From the internal circuit diagram of the scanning control circuit block 57, however, the manner is considered to be such that as follows. That is, when the control signal PD is turned to the H level, data to be transferred from the 200th stage to the 201st stage of a shift register in the Y driver is fixed at the L level, resulting in that outputs of the 201st to the 400th from the Y driver, which are fed to the scanning electrodes of the 200th to the 400th, are maintained at a non-selection voltage level.

FIG. 20 shows an example of driving voltage waveforms indicating a horizontal line at every other scanning-electrode line in the partial display state of this conventional example. A represents waveforms of voltages applied to one pixel on the upper-half screen, and B represents waveforms of voltages applied to all the pixels on the lower-half screen. In the figure, bold lines in the waveforms A and B indicate scanning electrode driving waveforms, and thin lines indicate signal electrode driving waveforms.

A selection signal V0 (or V5) is sequentially applied to each line of the scanning electrodes for the upper-half screen in every selection period (one horizontal scanning period: 1 H), and a non-selection voltage V4 (or V1) is applied to other lines of the scanning electrodes. ON/OFF information regarding individual pixels on selected lines is sequentially applied to the signal electrodes synchronously with the horizontal scanning period. More particularly, in a period when application voltages for selected lines of the scanning electrodes are V0, V5 is applied to the signal electrodes of ON-pixels on selected lines and V3 is applied to the signal electrodes of OFF-pixels; in a period when application voltages are V5, V0 is applied to the signal electrodes of ON-pixels, and V2 is applied to the signal electrodes of OFF-pixels. The voltage applied to the liquid crystal for individual pixels is the differential voltage between the scanning voltage applied to the scanning electrode (the selection voltage and the non-selection voltage) and the signal voltage applied to the signal electrode (an ON-voltage and an OFF-voltage). On principle, when this differential voltage is higher, a pixel with a higher effective voltage is turned ON; while, when this differential voltage is lower, a pixel with a lower effective voltage is turned OFF.

On the other hand, as shown in B of FIG. 20, since no selection voltage is applied to the scanning electrode, effective voltages for pixels on the lower-half screen are reduced to be considerably lower than effective voltages applied to the OFF-pixels on the upper-half screen, causing the lower-half screen to be totally in the non-display state.

As shown with a liquid-crystal alternating-current driving signal M, FIG. 20 shows a case in which signal-polarity switching is carried out for a driving voltage in every selection period for 13 lines. In this way, in higher-duty driving for reduction of flickering, cross-talks, and other problems, signal-polarity switching must be carried out for the driving voltages in every selection period for some ten lines. Although the lower-half screen is in the non-display state, voltages applied to the scanning electrodes and the signal electrodes in the non-display region are varied, as shown in B of FIG. 20. In this case, a defect is caused such as that even after the screen turned to be in the partial display state, circuits such as drivers would still continue to operate, and charging and discharging of the liquid crystal would still continue; therefore, power consumption is not expectedly reduced.

For reference, for switching of the display duty, the simple-matrix liquid crystal display apparatus requires modification of setting the driving voltage. This will be described below with reference to FIG. 21, which is an internal circuit of the driving-voltage forming circuit block 54.

First, a description will be given of a construction and functions in FIG. 21. For driving a liquid crystal display panel of a duty higher than about 1/30 duty, voltages of six levels of V0 to V5 are necessary. The highest voltage to be applied to the liquid crystal is V0–V5, and the input power source voltage of V5 is used as it is for V0. By use of a variable resistor RV1 for contrast adjustment and a transistor Q1, the voltage V5 which will result in the suitable contrast is retrieved from an input power sources of 0 V and −24 V. Resistors R1 to R5 are used to divide the voltage V0–V5 for forming intermediate voltages, and operational amplifiers OP1 to OP4 are used to increase driving capacity of the intermediate voltages so as to output V1 to V4. Switches S2*a* and S2*b* are interlock switches, and either one of R3*a* and R3*b* is connected in series to R2·R4 in accordance with the level of the signal PD. Resistance values of R3*a* and R3*b* are differentiated so that V0 to V5 of a different voltage-division ratio can be formed according to the PD level.

Among V0 to V5 there is a relationship expressed by V0–V1=V1–V2 V3–V4=V4–V5, and a voltage division ratio (V0–V1)/(V0–V5) is called a bias ratio. Japanese Examined Patent Publication No. 57-57718 discloses that when the duty is 1/N, a preferable bias ratio is $1/(1+\sqrt{N})$. Accordingly, when resistance values of R3*a* and R3*b* are set for a 1/400 duty and a 1/200 duty, respectively, driving can be performed at preferable bias ratios.

To switch between duties, not only the bias-ratio switching is necessary, but the driving voltage (V0–V5) must also be modified. If the duty is switched from 1/400 to 1/200 with a fixed driving voltage, even when switching is performed so as to set preferable bias ratio, the display results in being of much lowered contrast. This is caused by the fact that time when selection voltages are added to the liquid crystal is duplicated to excessively increase effective voltages. In the conventional example, while necessity for the bias-ration switching and an implementation means therefor are disclosed in detail, necessity for the driving-voltage switching and an implementation means therefor are not disclosed in detail.

In particular, with a duty assumed to be 1/N, when N>>1, (V0–V5) must be adjusted substantially in proportion to $\sqrt{N}$. For example, if a preferable (V0–V5) in case of 1/400 duty is 28 V, (V0–V5) must be adjusted to $28V/\sqrt{2}\approx 20$ V in case of 1/200 duty. This voltage adjustment is to be carried out by apparatus users by adjusting the contrast-adjustment variable resistor RV1 every time when switching is performed between the full-screen display state and upper-half screen display state. It is very inconvenient for apparatus users. Supplement of a driving-voltage automatic setting means is mandatory; however, it is not so easy as a bias-ratio switching means and the driving-voltage forming circuit will be much complicated. For reference, in the conventional publications, a description is given to the effect that since reduced driving voltages would be sufficient in a half-screen display, power consumption would be further reduced. However, since a large volume of the reduction voltage of 8 V is consumed to allow the contrast-adjustment transistor Q1 to generate heat, the power consumption is not reduced so much.

When the partial display is considerably smaller to cover some ten lines to twenty lines, duty-switching is carried out according to that display. By this, a preferable bias ratio, such as 1/3 and 1/4, can be obtained. In this case, voltage necessary for driving the liquid crystal is not any more the six levels, but will instead be five levels for the 1/4 bias and four levels for the 1/4 levels. When five levels of voltages are necessary, the resistance value at the side to be connected to either one of the resistors R3*a* and R3*b* may be set to 0 Ω. However, when four levels of voltages are necessary, the resisters R2 and R4 need to be 0 Ω, not the resisters R3*a* or R3*b*. A bias-ratio switching means and a driving-voltage switching means in a case as described above are disclosed in Japanese Unexamined Patent Publication No. 7-281632. However, a further description regarding a construction of the foregoing will be omitted here.

According to the aforementioned methods that have been proposed to date, basic functions for causing partial lines of a liquid crystal display panel to be in a display state and for causing other lines to be in a non-display state are realized, and power consumption can also be reduced to a certain extent. However, there still remains problems such as that a driving-voltage forming circuit will be very complicated, the number of lines that can be displayed is limited because of hardware, and reduction of power consumption is not yet sufficient.

Furthermore, the former Japanese Unexamined Patent Publication No. 6-95621 is relevant to a transmissive-type liquid crystal display panel, and the latter Japanese Unexamined Patent Publication No. 7-281632 states only about a partial-display method, in which display types are not disclosed. Whatever the transmissive type or reflective type, when higher contrast is considered important, liquid crystal display panels of a normally-black type have been conventionally used. The reasons are described below.

In case of a normally-white type, since regions among dots to which voltage is not applied are in white, white-display regions of a screen appear sufficiently in white, but black-display regions do not appear sufficiently in black. In contrast, In case of the normally-black type, since regions among dots to which voltage is not applied are in black, black-display regions of a screen appear sufficiently in black, but white-display regions do not appear sufficiently in white. Display can be in higher contrast in the case the black-display region appear sufficiently in black than in the case where the white-display regions appear sufficiently in white. For these reasons, use of the normally-black type liquid crystal display panel provides higher contrast.

For reference, the normally-black type is a mode in which a black-display is provided when the effective voltage applied to the liquid crystal is an OFF-voltage which is lower than a threshold of the liquid crystal, and a white-display is provided when the application voltage is increased and an ON-voltage higher than the threshold of the liquid crystal is applied to the liquid crystal. On the other hand, the normally-white type is a mode in which a white-display is provided when the effective voltage applied to the liquid crystal is an OFF-voltage which is lower than a threshold of the liquid crystal, and a black-display is provided when the effective voltage is increased and an ON-voltage higher than the threshold of the liquid crystal is applied to the liquid crystal. For example, when a substantially 90-degree twisted nematic type liquid crystal is used, the liquid crystal display panel has a paired polarizers on two side faces of the liquid crystal display panel; when transmissive axes of the paired polarizers are arranged substantially parallel, the normally-black type is made; when the transmissive axes of the paired polarizers are arranged substantially perpendicular, the normally-white type is made.

FIG. 18 is a drawing illustrating a partial display state in the case when the normally-black type liquid crystal display panel 107 is used. Since the OFF-voltage or the effective voltage lower than the OFF-voltage is applied to the liquid crystal in the non-display region, as shown in the figure, the non-display region provides the black-display. On the other hand, in the reflective type liquid crystal display panel, characters must be displayed in black and the background must be displayed in white so that incident light is reflected to make a bright and easy-to-view display. However, with the normally-black type liquid crystal display panel, while the background of the display region appears in white, the non-display region appears in black. This partial display state is incompatible. Furthermore, with display dots positioned at the border between the display region and the non-display region on the display screen, black-display dots forming characters in the display region and black-display dots in the non-display region become adjacent dots, causing a chained-character display when it is viewed. This gives rise to a problem in that the characters displayed on the dots on the border between the display region and the non-display region are difficult to be identified. For making the non-display region a white display so as not to being incompatible, the ON-voltage needs to be applied to the liquid crystal in the non-display region. On principle, however, such a non-display region cannot be referred to as a real non-display region. If the non-display region is arranged to be the white-display, problems arise such as those described as below. Power consumption by circuits necessary for realizing such an arrangement cannot be reduced. In addition, in a case where liquid crystal molecules are arrayed in the horizontal direction in an OFF-state and are allowed to rise in an ON-state as a nematic liquid crystal, permittivity of liquid crystals in the ON-state is two to three times higher than that in the OFF-state. In this condition, when the liquid crystal is driven to an ON-state so as to display the non-display region in white, charging and discharging current due to AC driving of a liquid crystal layer is increased; in which case, as compared to the case in the full-screen display state, the power consumption in the full-screen display state is not reduced so much, or conversely, is increased.

As described above, when the normally-black type liquid crystal display panel is simply adopted for improvement of contrast, the resulting display is incompatible, because the non-display region is the black-display in the partial display state. Furthermore, if the non-display region is arranged to be the white-display which is not incompatible, it is difficult to refer to such an arrangement as realization of a partial display function when it is viewed on principle, and in addition, an object of power consumption cannot be achieved.

SUMMARY OF INVENTION

To these ends, an object of the present invention is to solve the problems with the conventional art and is to provide an electrooptical apparatus allowing great reduction of power consumption. It is another object to provide an electrooptical apparatus not allowing a driving-voltage forming circuit to be complicated for the partial display function, and allowing the size and the position of the partial display to set by software so as to improve general usability thereof.

It is another object to provide an liquid crystal display apparatus realizing a display not producing an incompatible result and allowing great reduction of power consumption in a partial display state when it is used as an electrooptical apparatus.

It is another object to provide a construction of a driving circuit suitable for driving the electrooptical apparatus of the present invention.

It is another object to provide an electronic equipment utilizing an electrooptical apparatus or a liquid crystal display apparatus as a display apparatus, which includes the partial display function, to allow reduction of power consumption.

The present invention provides a driving method for an electrooptical apparatus, in which a plurality of scanning electrodes and a plurality of signal electrodes are arranged to cross with each other and comprises a function partially causing a display screen to be a display region, characterized in that selection voltages are applied in a selection period and non-selection voltages are applied in a non-selection period to the scanning electrodes in the display region; and in a period other than the selection period, application voltages for all the scanning electrodes in the display region are fixed, and application voltages for all the signal electrodes are fixed at least in a predetermined period; by which the display screen is shifted to the partial display state. According to the present invention, in the partial display, in which only a partial region is in the display region state, potentials of all the scanning electrodes and all the signal electrodes are fixed at least in the predetermined period; therefore, periods in which charging and discharging are not caused with components, such as liquid crystal layers of electrooptical materials, electrodes, and driving circuits, to reduce power consumption by electrical quantity saved as above.

Furthermore, in the driving method for the electrooptical apparatus of the present invention, it is preferable that voltages for the scanning electrodes in the period when the application voltages for all the scanning electrodes are fixed are to be the non-selection voltages. In the case of the partial display, since the voltages of the scanning electrodes which are fixed are the non-selection voltages, the driving circuits can be formed of simple circuits.

Furthermore, in the driving method for the electrooptical apparatus of the present invention, it is preferable that the non-selection voltages are one level. In a non-display region access period, since the non-selection voltages can be fixed at one level, no voltage variation occurs; therefore, reduced power consumption can be implemented.

Furthermore, in the driving method for the electrooptical apparatus of the present invention, it is preferable that a forming circuit for driving voltages to be applied to the scanning electrodes and the signal electrodes stops its operation in the period when the individual application voltages for all the scanning electrodes and all the signal electrodes are fixed. More particularly, it is preferable that the driving-voltage forming circuit includes a charge-pump circuit that switches among a plurality of capacitor connections according to clocks to generate boosted voltages and dropped voltages, and operation of the charge-pump circuit is stopped in the period when the individual application voltages for all the scanning electrodes and all the signal electrodes are fixed. By such an arrangement, in the period of the partial display state, power consumption in the driving-voltage forming circuit can be reduced. When the charge-pump circuit is used for increasing or dropped voltages, in a manner such as that the timing clocks that switch among capacitors, wasted power consumption can be reduced.

In connection with the invention described above, one driving method for a simple-matrix liquid crystal display apparatus in which non-selection voltages are only one level is that called an MLS (multi-line selection) driving method that selects multilines of scanning electrodes simultaneously, and another is that called an SA (smart-addressing) driving method that selects scanning electrodes one by one. A proposal has been made in International Patent Application Laid-Open No. WO96/21880 stating that by combining the aforementioned methods and a driving-voltage forming circuit formed of a charge-pump circuit, power consumption by a liquid crystal display apparatus can be greatly reduced. The present invention aims for further reduction of power consumption based on the above-referenced WO96/21880 and by developing the concept so as to be applicable to a partial display function.

The period other than the selection period in the scanning electrodes in the display region refers to a period other than a period when the selection voltages are applied to display lines (hereinbelow, this period is referred to as non-display line access period), at which time potentials of all the scanning electrodes and all the signal electrodes are fixed so that power consumption in the driving circuits can be greatly reduced and the electrooptical apparatus can be a less-power-consumption type. Furthermore, stopping operations of the charge-pump circuit of the driving-voltage forming circuit in the period allows charging and discharging due to the capacitors therein to be avoided, further reducing the power consumption. In the period, the capacitors do not discharge electricity because power consumption in the driving circuits is very low, so that even when the charge-pump circuit stops its operations, variations of the driving voltages are within a level giving no rise to a problem.

Furthermore, in the driving method for the electrooptical apparatus of the present invention, it is preferable that the driving method includes a first display mode causing the full portion of the display screen to be in a display state and a second display mode causing one partial region to be in a display state of the display screen and the other to be a non-display state, and the length of the period when the selection voltages are applied to the individual scanning electrodes in the display region is not changed for the first display mode and the second display mode. According to this invention, times in which the selection voltages are applied to the scanning electrodes in the display regions in the case of the full-screen display and in the case of the partial display are the same; that is, duties are the same. Therefore, no modification of bias ratios and the driving voltages at the time of partial display is necessary, and the driving circuits, the driving-voltage forming circuit, and the like do not need to be complicated.

Furthermore, in the driving method for the electrooptical apparatus according to the present invention described above, it is preferable that potentials are set for the signal electrodes in the period other than the selection period for the scanning electrodes in the display region so that effective voltages to be applied to a liquid crystal for pixels in the display region in the display state are the same in the first display mode and the second display mode. According to this invention, since potentials of the signal electrodes are set such that the effective voltages applied to the liquid crystal of an electrooptical material become the same in two cases of the full-screen display and the partial display, an arrangement can be made such that contrast in the display regions remains unchanged.

Furthermore, in the driving method for the electrooptical apparatus according to the present invention described above, it is preferable that potentials to be applied to the signal electrodes in the period other than the selection period for the scanning electrodes in the display region are set so as to be the same as the application voltages for the signal electrodes in the case of an ON-display or an OFF-display in the first display mode. Since the signal voltages in the full-screen display are used as they are, the driving circuits and driving control can be simplified.

Furthermore, in the driving method for the electrooptical apparatus according to the present invention described above, it is preferable that the method is driven so that the plurality of scanning electrodes are simultaneously selected in the unit of a predetermined number and are sequentially selected on the basis of a predetermined number of units, and the application voltages for the signal electrodes in the case of the ON-display or the OFF-display in the second display mode are set so as to be the same as the application voltages for the signal electrodes in the case of full-screen ON-display or full-screen OFF-display in the first display mode. In such an arrangement, in the MLS driving method, the effective voltages applied to the liquid crystal in the display regions in the case of the full-screen display and in the case of the partial display can be arranged to be the same, and concurrently, image quality in the case of the partial display can be maintained to be sufficiently high. Increase in circuit size can also be minimized.

Furthermore, in the driving method for the electrooptical apparatus according to the present invention described above, it is preferable that the potentials to be applied to the signal electrodes in the period other than the selection period for the scanning electrodes in the display region are set by alternately switching, on the basis of the predetermined period for one-screen scanning, between the application potential when the ON-display is performed and the application potential when the OFF-display is performed in the full screen display state. Furthermore, in the driving method for an electrooptical apparatus according to the present invention described above, it is preferable that in the period other than the selection period for the scanning electrodes in the display region in the second display mode, polarity of the voltage difference between the scanning electrodes and the signal electrodes is inverted in every frame. In such an arrangement, power consumption in the non-display access period can be greatly reduced. When the number of the partial-display lines is small (for example, not greater than about 60 lines), even when liquid-crystal driving voltages for pixels on non-display lines are fixed, image quality of the entire screen is not lowered.

Furthermore, the present invention provides the driving method for the electrooptical apparatus, in which a plurality of scanning electrodes and a plurality of signal electrodes are arranged to cross with each other and comprises a function partially causing a display screen to be a display region, characterized in that selection voltages are applied in a selection period and non-selection voltages are applied in a non-selection period to the scanning electrodes in the display region; and the selection voltages are not applied, but the non-selection voltages are applied to the scanning electrodes in a region other than the display region of the display screen and the application voltages for all the signal electrodes are fixed at least in a period longer than a same-polarity driving period in polarity-inversion driving state and a full-screen display state; by which the display screen is changed to the partial display state. According to the present invention, in the partial display, in which only a partial region is the display region, potentials of all the scanning electrodes and all the signal electrodes are fixed at least in the predetermined period; therefore, periods in which charging and discharging are not caused with components, such as liquid crystal layers of electrooptical materials and driving circuits of electrodes, to reduce power consumption by electrical quantity saved as above.

Furthermore, in the driving method for the electrooptical apparatus according to the present invention described above, it is preferable that the application voltages for the signal electrodes are alternately switched between a potential when an ON-display is performed and a potential when an OFF-display is performed in the full-screen display state on the basis of a period which is at least longer than the same-polarity driving period in the polarity inversion driving state and the full-screen display state. Even in the non-display line access period, since polarity inversion is performed on a cycle basis for the driving voltages, such problems as direct-current application and crosstalk can be avoided.

The driving method for the electrooptical apparatus described above can be realized by use of a simple-matrix liquid crystal display apparatus or an active-matrix liquid crystal display apparatus.

Furthermore, the present invention provides an electrooptical apparatus according to the present invention is characterized to be driven by the driving method described above. By this arrangement, the electrooptical apparatus of a less-power-consumption type can be provided.

Furthermore, the present invention provides an electrooptical apparatus including a plurality of scanning electrodes and a plurality of signal electrodes which are arranged to cross with each other and a function partially causing a display screen to be a display region, characterized by comprising a scanning-electrode driving circuit for applying selection voltages to the plurality of scanning electrodes in a selection period and applying non-selection voltages to the plurality of scanning electrodes in a non-selection period; a signal-electrode driving circuit for applying signal voltages according to display data to the plurality of signal electrodes; setting means for setting positional information regarding a partial display region in the display screen; and control means for outputting a partial display control signal that controls the scanning-electrode driving circuit and the signal-electrode driving circuit based on the positional information set by the setting means; wherein the scanning-electrode driving circuit and the signal-electrode driving circuit driving the scanning electrodes and the signal electrodes according to the partial display control signal, so that the scanning electrodes and the signal electrodes in the display region in the display screen are driven so as to cause display according to the display data and the non-selection voltages are applied continuously to the scanning electrodes in the non-selection region in the display screen; by which a non-display state is caused. According to this present invention, no modification with respect to items such as duty, bias ratios, liquid-crystal driving voltages in hardware circuits for the partial display is required, the number of display lines or non-display lines and position can be set to a resister of the control circuit. With such an arrangement, an electrooptical apparatus with high general usability in which the number of partial display lines and the position can be set in software mode.

Furthermore, the electrooptical apparatus described above can be realized by use of a simple-matrix liquid crystal display apparatus or an active-matrix liquid crystal display apparatus.

Furthermore, the present invention provides a driving circuit for an electrooptical apparatus, in which a plurality of scanning electrodes and a plurality of signal electrodes are arranged to cross with each other and comprises a function partially causing a display screen to be a display region, characterized by comprising first driving means applying voltages to the plurality of scanning electrodes; and second driving means comprising a storing circuit to store display data and applying voltages selected according to the display data read from the storing circuit to the plurality of signal electrodes; the first driving means having a function that applies selection voltages in a selection period and applies non-selection voltages in a non-selection period to the scanning electrodes in the display region, and applies only the non-selection voltages to the scanning electrodes in other region of the display screen; and the second driving means having a function that reads the display data from the storing circuit in a period corresponding to the selection period for the scanning electrodes in the display region and fixed address for reading the display data from the storing circuit in other periods. According to the present invention, by stopping readout operations for the display data from the storing means included in a signal-electrode driving circuit, consumption current in the signal-electrode driving circuit in the non-display access period can be substantially reduced to about zero. At this time, when readout display information is fixed at 0 or 1, an output from the signal-electrode driving circuit can be fixed to the same voltage as that in the case of the full-screen ON-display or the full-screen OFF-display.

Furthermore, in the electrooptical apparatus according to the present invention described above, it is preferable that a shift register in the first driving means stops its shift operations in a period other than the selection period of the scanning electrodes in the display region. According to this invention, in the period, since the scanning-electrode driving circuit does not output the selection voltages, the shift register does not need to operate. When operations of the shift register is stopped by stopping a shift-clock, power consumption in the scanning-electrode driving circuit in this period can be substantially reduced to zero.

Furthermore, the present invention provides the driving circuit for an electrooptical apparatus, in which a plurality of scanning electrodes and a plurality of signal electrodes are arranged to cross with each other and comprises a function partially causing a display screen to be a display region, characterized by comprising a scanning-electrode driving circuit for applying selection voltages sequentially to the plurality of scanning electrodes according to shift operations by a shift register, the scanning-electrode driving circuit applying selection voltages in a selection period to the scanning electrodes in the display region of the display screen according to shift operations by the shift register and applying only the non-selection voltages to the scanning electrodes in other region of the display screen by stopping the shift operations by the shift register on a way when partially causing the display screen to be the display region, and the scanning-electrode driving circuit comprising an initial setting means to reset the shift register to an initial state when changing a state in which the display screen is caused to be in the partial display state to in a full-screen state. According to this invention, at the time of transition from the partial display state to the full-screen display state, scanning is not started from an undefined position and can be started from the first line of the scanning electrodes.

Furthermore, the present invention provides the electrooptical apparatus characterized by comprising the driving circuit and scanning electrodes and signal electrodes to be driven by the driving circuit. By this arrangement, a partial display can be implemented, and the electrooptical apparatus of a less-power-consumption type can be provided.

Furthermore, the present invention provides an electrooptical apparatus in which a plurality of scanning electrodes and a plurality of signal electrodes are arranged to cross with each other and comprises a function partially causing a display screen to be a display region, characterized by comprising first driving means applying voltages to the plurality of scanning electrodes; and second driving means comprising a storing circuit to store display data and applying voltages selected according to the display data read from the storing circuit to the plurality of signal electrodes; the first driving means having a function that applies selection voltages in a selection period and applies non-selection voltages in a non-selection period to the scanning electrodes in the display region of the display screen, and applies only the non-selection voltages to the scanning electrodes in other region of the display screen; and the second driving means having a function that applies voltages to the plurality of signal electrodes in a selection period of the scanning electrodes of the display region on the basis of display data read from the storing circuit and applies voltages to the plurality of signal electrodes in the other period on the basis of the same display data. According to the present invention, by stopping readout operations for the display data from the storing means included in a signal-electrode driving circuit, consumption current in the signal-electrode driving circuit in the non-display access period can be substantially reduced to about zero.

Furthermore, in the electrooptical apparatus according to the present invention described above, it is preferable that the second driving means alternately changes, in a period other than the selection period for scanning electrodes in the display region, the application voltages for the signal electrodes between a potential when an ON-display is performed and a potential when an OFF-display is performed in a full-screen display state, on the basis of a period which is at least longer than a same-polarity driving period in a polarity inversion driving in the full-screen display state. Even in the non-display line access period, since polarity inversion is performed on a cycle basis for the driving voltages, such problems as direct-current application and crosstalk can be avoided.

Furthermore, in the electrooptical apparatus according to the present invention described above, it is preferable that it comprises a driving-voltage forming circuit for forming voltages applied to the scanning electrodes or the signal electrodes to supply them to the driving means, the driving-voltage forming circuit including a contrast adjustment circuit for adjusting the application voltage, and characterized by stopping operations of the contrast adjustment circuit in a period other than the period of selection of the scanning electrodes in the display region. In the electrooptical apparatus of this invention, power consumption in the driving circuits in the non-display line access period is very small. Therefore, as long as the driving voltages are retained in the capacitors, even when the contrast adjustment circuit is stopped, variations of the driving voltages are very small, so that no rise is given to a substantial problem. Power consumption of the driving circuit can be further reduced by stopping the contrast adjustment circuit.

Furthermore, the present invention provides a driving method for a liquid crystal display apparatus which is a reflective type or a transflective type allowing a partial display state by enabling a partial region in a full screen of a liquid crystal display panel to be turned to a display state and the other to be turned to a non-display state, characterized in that the liquid crystal display panel is a normally-white type and effective voltages equal to or lower than the OFF-voltage are applied to a liquid crystal in the non-display region in the partial display state. By use of the normally-white type, the non-display region appears in white in the partial display state; therefore, display which is not incompatible can be provided. Furthermore, as a circuit means that applies effective voltages equal to or lower than the OFF-voltage to the liquid crystal in the non-display region, a simple means that use lower power consumption can be used; furthermore since permittivity of the liquid crystal in the non-display region is small, charging and discharging current due to AC driving of the liquid crystal is reduced; in which case, as compared to the case in the full-screen display state, the power consumption in the entire display apparatus can be greatly reduced.

Furthermore, in the driving method for the liquid crystal display apparatus according to the present invention described above, it is preferable that the liquid crystal display panel is a simple-matrix liquid crystal panel in which only non-selection voltages are applied to scanning electrodes in the non-display region in the partial display state. Furthermore, the liquid crystal display panel is a simple-matrix liquid crystal panel; and it is preferable that only voltages that turn to be the OFF-display are applied to the signal electrodes in the partial display state.

Furthermore, in the driving method for the liquid crystal display apparatus according to the present invention described above, it is preferable that the liquid crystal display panel is a simple-matrix liquid crystal panel in which only voltages equal to or lower than OFF-voltages are applied to a liquid crystal for pixels in the non-display region at least in the first frame changing to the partial display state, and only non-selection voltages are applied to scanning electrodes in the non-display region in and from the following frame. Furthermore, it is preferable that the liquid crystal display panel is an active-matrix type liquid crystal display panel, in which voltages equal to or lower than the OFF-voltage are applied to the liquid crystal for pixels in the non-display region at least in the first frame changing to the partial display state, and only voltages equal to or lower than the OFF-voltage are applied to the signal electrodes in an access period for the non-display region in and from the following frame.

By this arrangement, partial display regions are arranged in the line direction and in the column direction on the display screen, and other region can be arranged to be a non-display region. Furthermore, since the liquid crystal display panel is the normally-white type, the non-display region appears in white in the partial display state; therefore, a compatible display can be provided. Furthermore, since high voltages are not applied to pixels in the non-display region, less power consumption can be realized.

Furthermore, the present invention provides the liquid crystal display apparatus characterized to be driven by the driving method for the liquid crystal display apparatus and provides a liquid crystal display apparatus of less-power-consumption type and less incompatible even in the partial display state.

Furthermore, the present invention provides an electronic equipment utilizing the electrooptical apparatus or the liquid crystal display apparatus as a display apparatus. Particularly, when the electronic equipment uses battery as a power source, battery service life can be extended.

BRIEF DESCRIPTION OF THE DRAWINGS

FIGS. 4A–4C are drawings to be used to explain liquid-crystal driving-voltage waveforms according to the embodiment in the present invention; A shows selection voltage VS field (Corn pattern), FIG. 4B shows a display pattern, and C shows signal electrode driving voltage VS display pattern. In FIG. 4A, Y4n+1 to Y4n+4 indicate selected first to fourth lines(n=0, 1, 2, . . ., 49). 1 indicates VL. The matrix in drawing FIG. 4A holds when the liquid crystal AC driving signal M is L, and the matrix is reversed when signal M is H. In FIG. 4B, d1 to d4 indicate ON/OFF state of the pixels of selected first to fourth lines. −1 indicates ON pixels and 1 indicates OFF pixels. In FIG. 4C, O indicates VC, ±2 indicates ±V1, and ±4 indicates ±V2 from the arithmetic results. The matrix in the FIG. 4C holds when the liquid crystal AC driving signal M is L, and the matrix is reversed when signal M is H;

Figure 1:
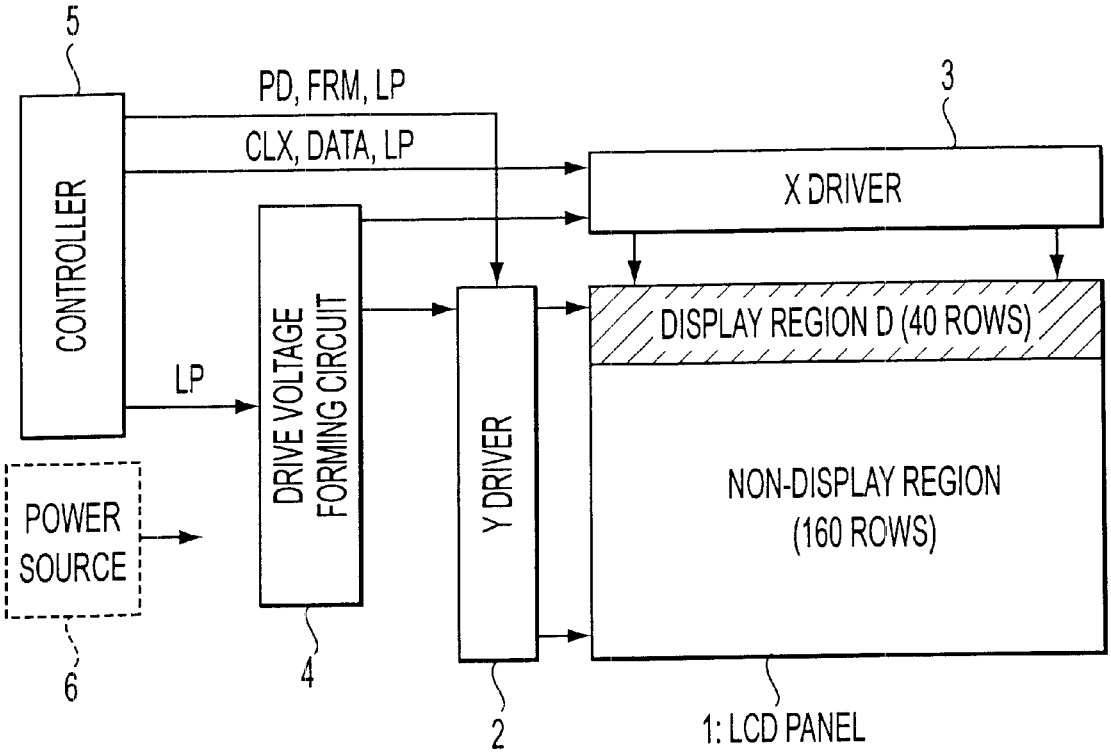
FIG. 1 is a block diagram of a liquid crystal display apparatus in an embodiment of the present invention.

1, 51 liquid crystal display panel
2, 52 scanning-electrode driving circuit (Y driver)
3, 53 signal-electrode driving circuit (X driver)
4, 54 liquid-crystal driving-voltage forming circuit
5, 55 LCD controller
6, 56 power source
7, 17 voltage-boosting/voltage-dropping clock forming circuit
8 negative-direction sixfold voltage-boosting circuit
9, 20 twofold voltage-boosting circuit
10 negative-direction twofold voltage-boosting circuit
11, 12, 19 1/2-voltage-dropping circuit
13, 21 contrast adjustment circuit
14 register
15 partial-display control-signal forming block

16 AND gate
18 negative direction eightfold voltage-boosting circuit
22 precharge signal generation circuit
23 line address generation circuit
24, 31 Com-pattern generation circuit
25 display data RAM
26 readout display data control circuit
27 X-driver MLS decoder
28, 34 level shifter
29, 35 voltage selector
30 initial-setting-signal generation circuit
32 shift register
33 Y-driver MLS decoder
57 scanning control circuit
107 normally-black type liquid crystal display panel
FRM frame start signal (screen-scanning start signal)
CA field start signal
CLY scanning-signal transfer clock
CLX data-transfer clock
Data, Dn display data
LP, LPI data latch signal
PD, CNT, PDH partial display control signals
Don display control signal
Vcc input power source voltage
GND ground potential
VEE negative-side high voltage
VH positive-side selection voltage
VL negative-side selection voltage
VC non-selection voltage(center potential)
±V1, ±V2, ±VX (, VC) signal voltages
V0 to V5 liquid-crystal driving voltages
f1 to f4 field identifier
M liquid-crystal alternating-current driving signal
Xn signal electrode
Y1 to Y200, $Y_{4n+1}$ to $Y_{4n+4}$ scanning electrodes
RV, RV1 variable resistors
Qb, Q1 bipolar transistor
Qn n-channel MOS transistor
R1, R2, R3*a*, R3*b*, R4, R5 resistors
S2*a*, S2*b* switches
OP1 to OP4 operation amplifiers
D partial display region
VS positive-side selection voltage
MVS negative-side selection voltage
VX positive-side signal voltage

DESCRIPTION OF THE PREFERRED EMBODIMENTS

Hereinbelow, preferred embodiments of the present invention will be described with reference to the drawings.

FIG. 1 is a block diagram showing an liquid crystal display apparatus as an embodiment of the present invention. First, an arrangement of this embodiment will be described. A block 1 represents a simple-matrix liquid crystal display panel (LCD panel) using a super-twisted-nematic (STN) liquid crystal, in which a substrate on which plural scanning electrodes are formed and a substrate on which plural signal electrodes are formed are arranged to oppose each other with a several-$\mu$m gap, and the aforementioned liquid crystal is enclosed in the gap. By the liquid crystal at cross sections of the plural scanning electrodes and the plural signal electrodes, pixels (dots) are to be formed in a matrix. Furthermore, polarizing elements, such as a polarizer and retardation film, are arranged on an outer surface of the panel when they are necessary.

For reference, the liquid crystal is not limited to the STN type used in this embodiment, but other types such as a type in which liquid crystal molecules are twisted (a TN type), a homeotropically oriented type, a vertically oriented type, and a memory type such as a ferroelectric type may be used. Furthermore, a liquid crystal of macromolecule dispersion type may also be used. The liquid crystal display panel may be a transmissive type, a reflective type, or a transflective type; however, the reflective type or the transflective type is preferable for power-consumption reduction. For arrangement of the liquid crystal display panel 1 to be a color display type, a manner in which a color filter is formed or a manner in which three colors to be illuminated by an illumination unit are switched among them in time series are considered.

A block 2 represents a scanning-electrode driving circuit (Y driver) that drives the scanning electrodes of the liquid crystal display panel, and a block 3 represents a signal-electrode driving circuit (X driver) that drives the signal electrodes of the liquid crystal display panel. Plural voltage levels necessary for driving the liquid crystal are formed in a driving-voltage forming circuit represented by a block 4 and are applied to the liquid crystal display panel 1 through the X driver 3 and the Y driver 2. A block 5 represents a controller that supplies signals necessary for these circuits, PD denotes a partial display control signal, FRM denotes a frame start signal, CLX denotes a data transfer clock, and Data denotes display data. LP denotes a data latch signal, and the latch signal also functions as a scanning-signal transfer clock and a driving-voltage forming circuit clock. A block 6 represents a power source for the circuits described above.

The controller 5, the driving-voltage forming circuit 4, the X driver 3, and Y driver 2 are individually shown in the separate blocks; however, they do not need to be separate ICs. For example, the controller 5 may be formed in the Y driver 2 or the X driver 3, the driving voltage forming circuit may be formed in the y driver 2 or the X driver 3, the X and Y drivers may be formed of a single-chip IC, and furthermore, all of these circuits may be grouped in a single-chip IC. Furthermore, for example, these circuit blocks may be arranged on a substrate different from the liquid crystal display panel 1, may be placed on the substrates constituting the liquid crystal display panel 1 as ICs, or may be formed on the substrates.

Since the liquid crystal display apparatus of the present invention is a simple-matrix type, a driving method in which voltages to be applied to the scanning electrodes of non-selection lines are one level; therefore, the driving circuits are simpler and the power consumption can be reduced. For reference, regarding non-selection voltages, two voltage levels may be prepared according to the polarity of the application voltages to the liquid crystal and a driving method that selects them alternately according to polarity inversion may be adopted. Particularly, such a method is used in an active-matrix liquid crystal display apparatus that has two-terminal type nonlinear element in pixels, which will described later.

Furthermore, a main section of the driving-voltage forming circuit 4 in FIG. 1 is formed of a charge-pump circuit that boosts or drops voltage. However, a voltage-boosting/voltage-dropping circuit other than the charge-pump circuit may be used.

The liquid crystal display panel 1 has, for example, 200 lines (the number of the scanning electrodes) in total and it is in a full-screen display state (full-screen display mode) when it is necessary. At a time such as a wait time, however, only 40 of the 200 lines turn to be in a display state, and the remaining 160 lines turn to be in a non-display state (partial display mode). Regarding the driving method, a detailed description is included in descriptions which will be given below of embodiments.

FIRST EMBODIMENT

Hereinbelow, referring FIGS. 2 to 4, a description will be given of an example case where partial display is performed by use of a driving method (hereinafter, it is indicated as a 4MLS (Multi-Line-Selection) that simultaneously selects four lines of scanning electrodes and performs simultaneous selection sequentially on a basis of 4-line scanning electrodes. First, a description will be given of an example of a driving-voltage forming circuit 4 for an MLS driving method, with reference to FIG. 2, which is a block diagram thereof.

In the MLS driving method, as scanning signal voltages (scanning voltages output by a Y driver 2), three voltages, which are a non-selection voltage VC, a positive-side selection voltage VH (a positive voltage based on VC), and a negative-side selection voltage VL (a negative voltage based on VC), are necessary. VH and VL are symmetrical with each other with respect to VC as the center. In a 4MLS driving method, as signal voltages (signal voltages output by an X driver 3), five voltage levels, which are ±V2s, ±V1s, and VC, are necessary, and voltages corresponding to the ±V2s and the ±V1s are symmetrical with each other with respect to VC as the center. A circuit in FIG. 2 uses (Vcc−GND) as an input power-source voltage and uses a data latch signal LP as a clock source of a charge-pump circuit to output the foregoing voltages. Hereinbelow, as long as no particular notes will be given, a description will be made with an assumption for GND to be a reference (0 V) and an assumption of Vcc=3 V. For the respective VC and V2, GND and Vcc are used as they are.

A block 7 represents an voltage-boosting/voltage-dropping clock forming circuit that forms a 2-phase clock having a smaller time gap to operate the charge-pump circuit from the data latch signal LP. A block 8 represents a negative-direction sixfold voltage-boosting circuit that forms a voltage VEE≈−15 V with the (Vcc−GND) as the input power source voltage, which is a sixfold voltage of an input power source voltage in a negative direction on a basis of VCC. For reference, hereinbelow, the negative direction refers to a direction of a negative voltage, and in the same way as the above, a positive direction refers to the direction of a positive voltage. A block 13 represents a contrast adjustment circuit that retrieves a necessary negative selection voltage VL (for example, −11 V) from VEE, and it is formed of a bipolar transistor and a resistor. A block 9 represents a twofold voltage-boosting circuit for forming the positive selection voltage VH, which forms VH (for example, 11 V) with the (GND−VL) as the input voltage, which is a twofold voltage of the input voltage in the positive direction on a basis of VL.

A block 10 is a negative-direction twofold voltage-boosting circuit that forms −V2≈−3 V, which is a twofold voltage of an input power source voltage in a negative direction with the (Vcc−GND) as the input power source voltage on a basis of Vcc. A block 11 is a 1/2-voltage-dropping circuit that uses the (Vcc−GND) as the input power source voltage to form V1≈−1.5 V, which is a voltage reduced from the input power source voltage by half. A block 12 is also a 1/2-voltage-dropping circuit that uses a (GND−[−V2]) as the input power source voltage to form V1≈−1.5 V, which is a voltage reduced from the input power source voltage by half.

As described above, voltages necessary for the 4MLS driving method can be formed. Any one of the blocks 8 to 12 is a voltage-boosting/voltage-dropping circuit using a charge-pump method. Since a driving-voltage forming circuit according to such a voltage-boosting/voltage-dropping circuit of the charge-pump method provides a higher power-supply efficiency, the liquid crystal display apparatus can be driven by the 4MLS driving method with less power consumption. For reference, each of the individual charge-pump circuits represented by the blocks 8 to 12 has a well-known arrangement. For example, with the voltage-boosting circuit, after N pieces of capacitors are parallel-connected and are charged with an input voltage, N pieces of the capacitors are serially connected, in which case an N-fold boosted voltage can be obtained; with the voltage-dropping circuit, after N pieces of capacitors of the same capacitance are serially connected and are charged through two ends thereof with an input voltage, N pieces of the capacitors are parallel-connected, in which case one-Nth dropped voltage can be obtained. The 2-phase clock formed by the voltage-boosting/voltage-dropping clock forming circuit 7 functions as a control clock that performs switching between serial connection and parallel connection of these capacitors.

For reference, all or some of the circuit blocks 8 to 12 in the driving-voltage forming circuit 4 may not need to be the charge-pump circuits, but they may be arranged by replacing with well-known switching regulators that utilize coils and capacitors.

Figure 2:
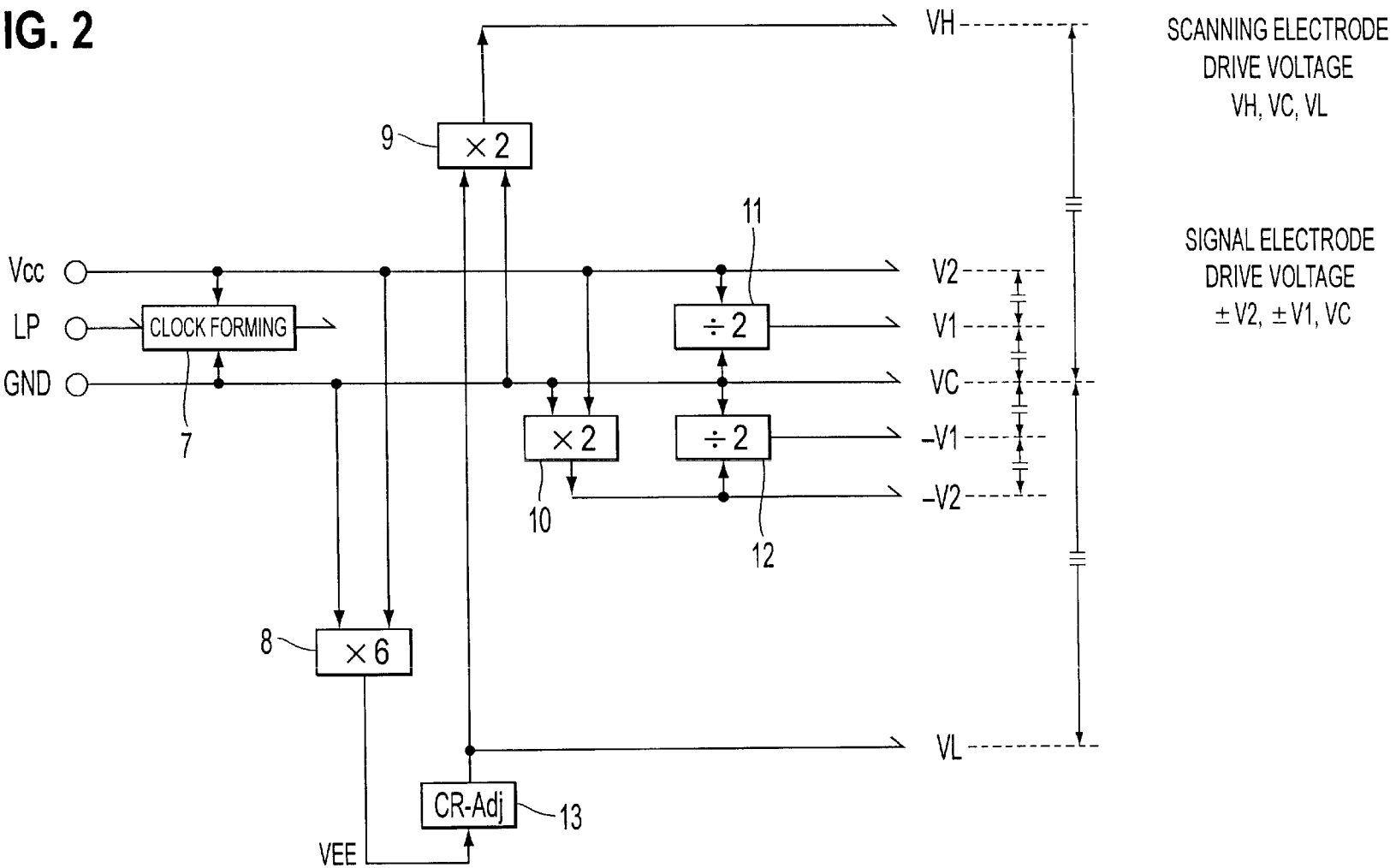
FIG. 2 is a block diagram of a driving-voltage forming circuit to be used in the embodiment of the present invention.
Figure 3:
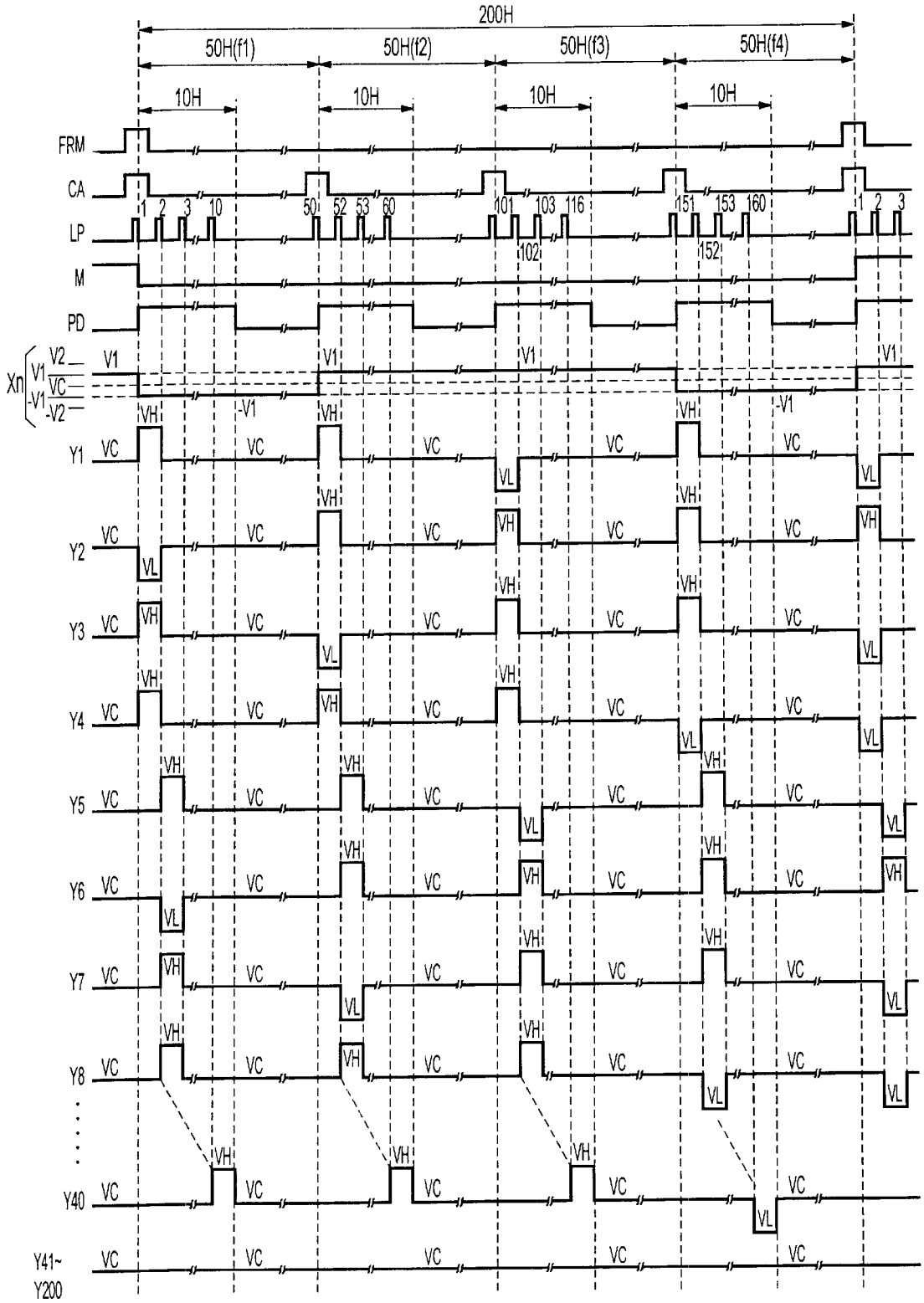
FIG. 3 shows timing charts according to the embodiment of the present invention.

FIG. 3 shows example timing charts including liquid-crystal driving-voltage waveforms of the liquid crystal display apparatus shown in FIGS. 1 and 2. FIGS. 4A–4C are drawings to be used for explaining the liquid-crystal driving-voltage waveforms. The example in FIG. 3 represents a case in which a full screen is composed of 200 scanning lines in total and only 40 lines thereof are in a display state, and in the displayed regions there are displayed a horizontal line at every other scanning electrode. An interval between pulses of a frame start signal FRM is assumed to be a one-frame period in which one screen is scanned, of which length 200 H (1 H represents one selection period or one horizontal period).

CA represents a field start signal, and one frame is separated into four fields f1 to f4, each of which takes 50 H. Period of the data latch signal LP is 1 H, and four lines of the scanning electrodes are selected at the same time at every clock of the signal LP. The selection voltage VH or VL is applied to the scanning-electrode lines selected, and the non-selection voltage VC is applied to the other scanning-electrode lines. Waveforms Y1 to Y40 and Y41 to Y200 represent 200 lines of scanning-voltage driving waveforms applied to scanning electrodes. Sequential selection is performed for the scanning electrodes Y1 to Y4 at a first clock, the Y5 to the Y8 at a second clock, . . . , the Y37 to the Y40 at a tenth clock, thus performing one round selection for the 40 lines in 10 H. During a period in which certain four lines of the 40 lines are being selected, a partial display control signal PD is set at an H level; and the partial display control signal PD is maintained at the H level in the 10-H selection period for the 40 lines. Upon completion of selection for the 40 lines, the partial display control signal PD is turned to an L level and is maintained at the L level in the remaining period in the 50 H for one field. Normally, the Y driver 2 has a control terminal that fixes asynchronously every output at the non-selection voltage VC by using an input control signal. As a result of input of the partial display control signal PD to such a control terminal as that of the Y driver 2, all of the 200 scanning-electrode lines become fixed at the non-selection voltage level VC in a non-display-line access period of 40 H of the 50 H for one field "f" in which the partial display control signal PD turns to the L period.

For reference, M represents a liquid-crystal alternating-current driving signal which causes polarity-switching for a driving voltage (a difference between a scanning voltage and a signal voltage) applied to the liquid crystal for the pixels according to the H level and the L level. Xn represents a signal electrode driving waveform applied to an n-th signal electrode in the case where a horizontal line is displayed in every other scanning electrode line in a displayed region when only the lines 1 to 40 are in the display state and the lines 41 to 200 are in the non-display state.

The above operations are repeated for individual fields; however, a manner in which the positive selection voltage VH and the negative-side selection voltage VL, which are applied to the selected four lines of the scanning electrodes, are provided is different for each of the fields f1 to f4. This is illustrated in FIG. 4A. For example, the selection voltages applied to the selected four lines of the scanning electrodes are sequenced as VH, VL, VH, VH from the first line to the fourth line in the field f1; while the foregoing selection voltages are sequenced as VH, VH, VL, and VH from the first lines to the fourth line in the field f2. A combination of the selection voltages in the individual fields is referred to as a Com pattern. FIG. 4A shows a determinant in which VH is represented by 1 and VL is represented by −1, and such a Com pattern as that shown is based on an orthonormal matrix.

The signal voltage is determined depending upon the display pattern and the Com pattern. FIG. 4B shows a case when a display pattern is expressed in a four-lines one-column determinant with ON-pixels as −1 and OFF-pixels as 1. In this case, in each of the field f1 to f4, signal voltages applied to pixels in lines $Y_{4n+1}$ to $Y_{4n+4}$ can be expressed by the products of the Com patterns and the display patterns, as shown in FIG. 4C. In other words, each line of the lines of the products is signal voltages to be applied to signal electrodes according to display of the pixels of your lines. For example, according to FIG. 4C, a signal voltage based on a result of the operation (d1−d2+d3+d4) is applied to a signal electrode Xn in the field f1, a signal voltage based on a result of the operation (d1+d2−d3+d4) is applied in the field f2, and signal voltages are also determined based on results of the operations for the fields f3 and f4, as shown in FIG. 4C. For reference, in results of the operations, 0 expresses VC, ±2 expresses ±V1, and ±4 expresses ±V2.

In particular, for example, when a full screen is in the ON-display state (all the d1 to the d4 is −1), operation results for all the individual lines are −2; therefore, the signal voltage in any of the fields is determined to be −V1. When a full screen is in the OFF-display state (all the d1 to the d4 is 1), operation results for all the individual lines are 2; therefore, the signal voltage in any of the fields is determined to be V1. When the horizontal line is displayed in every other line of the scanning electrodes (d1=d3=−1, d2=d4=1), since the individual operation results for the fields f1 and f4 are −2, the signal voltages are determined to be −V1; and since the individual operations for the fields f2 and f3 are 2; the signal voltages are determined to be V1.

In FIG. 3, in a period when the selection voltage is being applied to the scanning electrode, as described above, the driving voltage selected as a result of the operation performed according to the display pattern is applied to the signal electrode Xn. It is not preferable that a signal voltage in the non-display-line access period of 40 H be fixed at VC. This is because in the case of the signal voltage in the non-display-line access period of 40 H, effective voltages to be applied to the liquid crystal in the display region in two states must be the same so that contrast in the region of 1 to 40 lines being displayed remains unchanged when switching is performed between a full-screen display state and a partial display state. For this reason, here, for the signal voltage in the period, the voltage −V during selection of the scanning voltages of the last four lines (Y37 to Y40) in the display region is maintained as it is. Although the signal voltages in the non-display-line access period of 40 H are individually fixed at a constant voltage within one field, they are not always at the same voltage in the individual fields. A driving voltage of signal electrode Xn varies to the −V1, V1, V1, and then the −V1 in the non-display-line access period of 40 H in each field. In this way, the signal voltages in the non-display-line access period of 40 H in the individual fields do not need to be fixed at the same voltage in the individual fields, and they also vary according to polarity inversion of a liquid-crystal driving voltage, which will be described below.

M represents the liquid-crystal alternating-current driving signal, and FIG. 3 shows a case when polarity of the liquid-crystal driving voltage is inverted on a one-frame basis. When the level of the liquid-crystal alternating-current driving signal M is inverted, polarity of the Corn pattern in FIG. 4A described above is inverted (1 is inverted to −1; 1 is inverted to −1), and accordingly to the above, VC-based polarity of the selection voltage and the signal voltage which are applied to the scanning electrodes and the signal electrodes is also inverted. In the full-screen display state, liquid-crystal alternating-current driving signal M is inverted at every 11 H and polarity of the selection voltages applied to is also inverted at every 11 H so that occurrence of display crosstalks is to be reduced. On the other hand, in the partial display state, polarity inversion in the case of a display region D is performed at every 11 H in the same manner as that in the case of full-screen display state; however, polarity of the application voltages for the liquid crystal are inverted at a period longer than 11 H. When the partial-display region is small, a non-display line access period is extended and potentials of the signal electrodes and the scanning electrodes are fixed in a long period after the display region D is driven at a higher duty, and the polarity inversion is performed in each frame. However, as a result of an experiment, no problem occurred with image quality. Furthermore, it is preferable from the viewpoint of reduction of power consumption for the following reason. In the non-display-line access period, because of fixation of the liquid-crystal driving voltage, power consumption due to charging and discharging current and passing-over current that would be generated due to voltage variation in liquid crystal layers, a Y driver 2 and an X driver 3, and the controller 5 is much smaller. The larger the non-display region, the longer the non-display-line access period and also the longer the period of fixation of the scanning voltages and the signal voltages; by which charging and discharging in the liquid crystal and circuits are reduced to allow less power consumption.

In the above manners, the partial-display function of the 4MLS driving method can be realized. In these manners, power consumption in the partial display state can be reduced to an extent substantially in proportion to the number of lines.

For reference, when a liquid crystal display panel 1 is in the full-screen display state, the partial display control signal PD is usually at the H level and the data latch signal LP is continuously fed to sequentially select the scanning electrodes Y1 to Y200 in the unit of four lines. Furthermore, in the full-screen display state, the polarity inversion must be performed in each predetermined period. For example, the polarity inversion must be performed in a manner that polarity-switching for the selection electrodes and the signal voltages are performed at every 11 H. As an alternative manner, the polarity inversion of the liquid-crystal driving electrodes may be performed in every frame period, or the polarity inversion may be performed in each predetermined period in a frame.

Furthermore, in the case of the full-screen display and in the case of the partial display on partial lines, application time and voltage of the selection voltages for the individual scanning electrodes are the same. Therefore, there is no additional element necessary for the driving-voltage forming circuit 4 because of the partial-display function.

For reference, in the above embodiment, the case in which the MLS driving method performs four-line simultaneous selection has been described; however, the number of the simultaneous selection lines is not limited to four and it may be any plural number such as two or seven. According to a change in the number of the simultaneous selection, the period of one field is also to be changed. Furthermore, although the case in which application of the selection voltages is equally distributed within one frame has been described, a case in which such equal distribution is not performed (for example, an in-frame-grouping manner in which selection of the Y1 to the Y4 is continuously performed in 4 H, selection of the Y5 to the Y8 is continuously performed in the consecutive 4 H) is also applicable. Furthermore, in the embodiment, 200 lines are set for the full-screen display, and the number of the partial-display lines is set as 40 lines; however, these are not restricted state, nor is the partial display portion restricted thereto.

Furthermore, in the above embodiment, the number of clocks of the data latch signal LP in every field has been described as (number-of-display-lines/number-of simultaneous-selection-lines); however, in consideration of restriction of drivers and the like, a case in which the number of the clocks is increased a little to be about 10 H is included in the scope of the present invention.

SECOND EMBODIMENT

Figure 5:
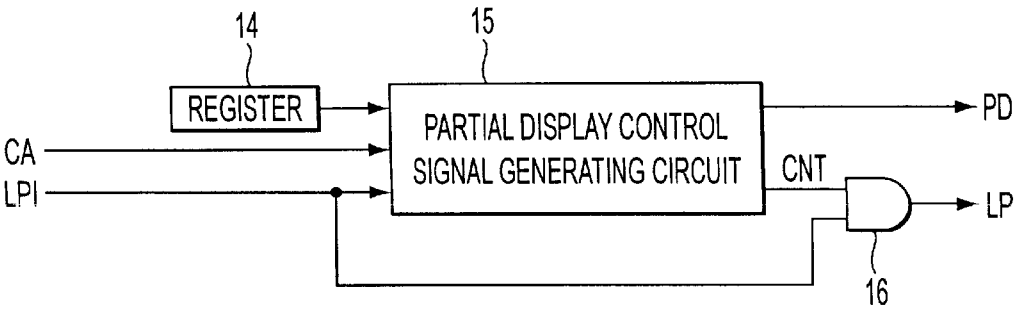
FIG. 5 is a fragmentary view of a control circuit according to the embodiment of the present invention.
Figure 6:
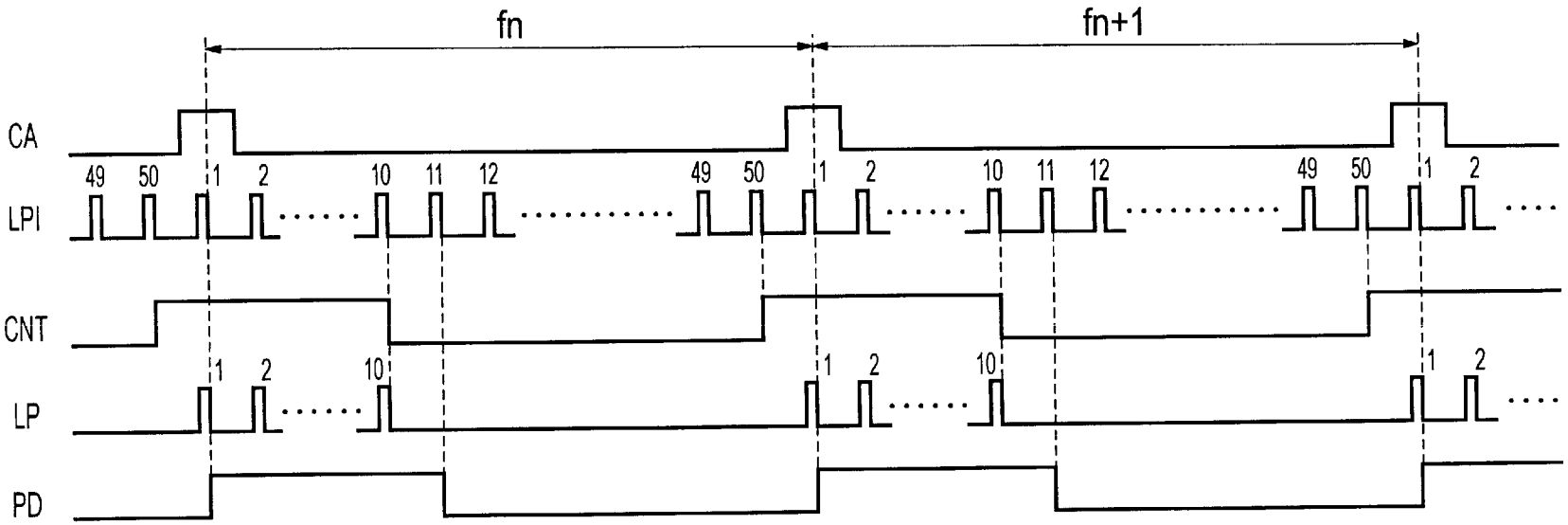
FIG. 6 shows timing charts representing operations of circuits in FIG. 5.

Next, this embodiment will be described with reference to drawings 5 and 6. FIG. 5 is a circuit diagram showing part of the controller 5 in FIG. 1, which is a circuit block that controls the partial display state. FIG. 6 is a drawing showing timing charts that describe performance of the circuit in FIG. 5, and it is a supplemental and enlarged drawing showing part of the timing charts in FIG. 3 for the first embodiment. Construction and performance of a liquid crystal display apparatus of this invention is the same as those of the first embodiment described above. Therefore, descriptions regarding the same portions as those of the first embodiment will be omitted.

First, a circuit construction in FIG. 5 will be described. The numeral 14 denotes a register of 8 bits or the like, in which there are defined information on whether or not a display state is a partial display state and defied information corresponding to the number of lines to be displayed. When the number of the lines are to be defied in 7 bits, the partial display of up to $2^7$=128 lines can be defined on a one-line basis on a panel that sequentially drives line by line, and the partial display of up to $2^7$×4=512 lines can be defined on a four-line basis on a four-line-simultaneous-selection driving panel (4MLS driving method).

The numeral 15 denotes a circuit block mainly constituted of a counter, which forms the timing signal PD and CNT that control the partial display according to the timing signal, such as a field start signal CA and a data latch signal LPI, and values set in the register 14. LPI is a source signal of an LP and is, as shown in FIG. 6, a signal having clocks that maintain a constant cycle even when PD is at the L-level non-display-line access period. The numeral 16 denotes an AND gate.

As shown in FIG. 6, the partial-display control-signal forming block 15 first forms the signal CNT 1-H preceding the partial display control signal PD according to the field start signal CA, the data latch signal LPI, and the setting values of the register. In the circuit block 15, for example, the CNT can be formed in a manner in which CNT levels are switched therebetween by matching-detection between values obtained from the counter that inputs an LPI to count lines and values obtained from the setting values of the resister 14. An AND output of the CNT and LPI is LP. The PD is formed by delaying the CNT by 1 H with LPI. In a full-screen display state, the CNT is regularly at the H level, in which case the AND gate 16 is left to be open and the same signal as LPI is sent out to LP. By this, all the 200 lines of the scanning electrodes field start signals CAs are selected in the unit of a predetermined number of lines.

In the partial display, PD indicating a partial display period in one-field period is turned to the H level in a period specified by a setting value. When this PD controls outputs of LP by use of the CNT having the H level of a length corresponding to the H-level period, the data latch signal LP is output only in the H-level period.

In the aforementioned manner, a value corresponding to the number of partial-display lines is set in the register 14 of the control circuit, and PD (CNT) is adjusted according to the setting value, so that the number of the partial-display lines can be changed. In implementation of the partial-display function, there is no need to arrange hardware-restrictive means such as those for changing LP cycles, bias ratio, and selection voltages. Therefore, users can define a desired number of the display lines in a setting means, such as a register, in software mode. This makes the liquid crystal display apparatus having a partial-display function that provides increased general usability.

For reference, for the above examples, only cases have been described, in which the partial display of only a constant number of lines from the top of the panel is performed; however, with two units of the setting means, i.e., registers, arranged, when values corresponding to the start line and the end line of the partial-display region are set in the respective registers, the position of the partial-display region can also be changed, in addition to the number of lines. In this case, the partial-display control-signal forming block 15 performs control so that when a value of a count by the aforementioned counter and the start line set in a first register are compared and they have matched, the CNT is turned to H; when a value of a count by the counter and the end line set in a second register are compared and they have matched, the CNT is turned to L.

THIRD EMBODIMENT

This embodiment is different from the first embodiment only in an aspect in which potentials of signal electrodes in the non-display-line access period are fixed at the same levels of those in the case of full-screen OFF display. This embodiment is the same as the first embodiment in that it adopts the 4MLS driving method of the selection-voltage equal distribution type using the Corn pattern in FIG. 4A, and as shown in FIG. 2, the driving-voltage forming circuit 4 mainly constituted of the charge-pump circuit; a full screen has 200 lines of the scanning electrodes and only 40 of the 200 lines are in the display state; it is an example case in which the horizontal line is displayed at every other scanning electrode in the display state portions; the length of the one-frame period is 200 H; the application voltage for the scanning electrodes in the non-display-line access period is fixed at the non-selection voltage VC; and the polarity of the liquid-crystal driving voltage is inverted in every frame. Therefore, descriptions regarding the same portions as those in the first embodiment will be omitted.

Figure 7:
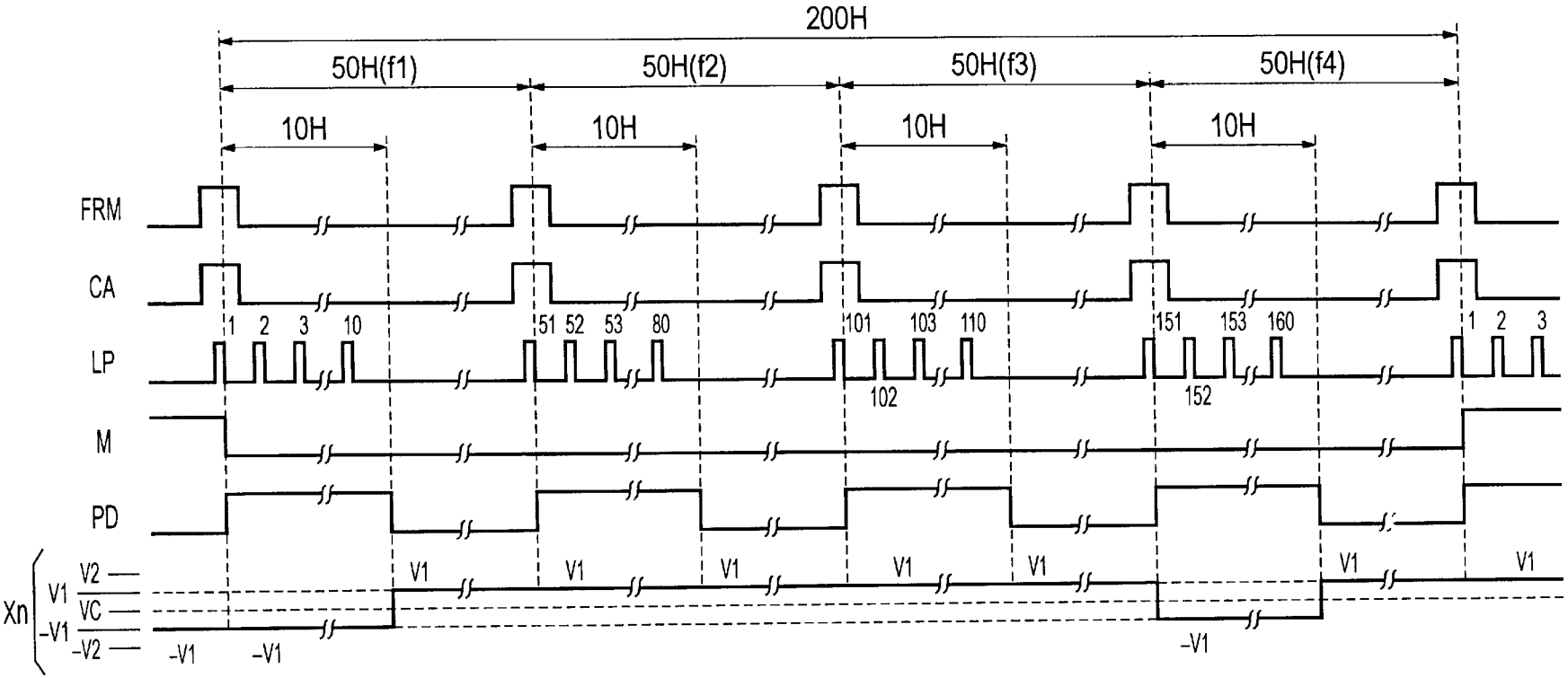
FIG. 7 shows timing charts according to another embodiment of the present invention.

FIG. 7 is a drawing showing timing charts of this embodiment, which is different from FIG. 3 described for the first embodiment only in the waveform applied to the signal electrode Xn. The waveforms applied to the scanning electrodes Y1 to Y200 are the same as those in FIG. 3; therefore, they are omitted.

In this embodiment, potentials applied to the signal electrode Xn in the non-display-line access period (a period of 40 H in each field f) are fixed at ±V1, as in the same case of the full-screen display. That is, the signal voltages in the non-display-line access period are fixed at V1 when the liquid-crystal alternating-current driving signal M is at L, and at −V1 when M is at H, so that they are inverted in every frame.

In this way, effective voltages to be applied to the liquid crystal in a display region can be uniformed in either cases of the full-screen display state or the partial display state, so that a contrast in a display region can remain unchanged when the two states of the full-screen display and the partial display are switched therebetween. Fixation of the signal voltages in the non-display-line access period at the same voltages as those in the full-screen OFF-display can be implemented by provision of slight changes to the X driver 3. A manner for this implementation this will be described in a section of a sixth embodiment.

For signal voltages in a non-display-line access period, there is a manner in which, as in the case of the first embodiment, the voltages at selection of the last four lines of the scanning electrodes (Y37 to Y40) in the display region are continued to be used; however, from the viewpoint of avoidance of flicker, it is more preferable that, as in the case of this embodiment, the voltages be arranged to be at levels in the case of full-screen OFF-display or full-screen ON-display, by which flicker can be avoided.

Reasons for the above will be described below. In the first embodiment, when display patterns of the last four lines in a partial-display region are an ON-display in three lines and an OFF-display in the remaining one line, or in inverse, are an OFF-display in three lines and an ON-display in the remaining one line, the signal voltage turns to VC in three fields and turns to the −V2 or V2 in the remaining one field, depending upon the number of ON-lines in the last four lines in the partial-display region. Accordingly, the signal voltage in an non-display-line access period also turns to VC in three of the four lines and turns to the −V2 or V2 in the remaining one field, depending upon the number of ON-lines in the last four lines in the partial-display region.

On the other hand, in this embodiment, as described above, all the four fields turn out to be of the −V1 (a signal electrode voltage for displaying all-pixel in ON-state) or V1 (a signal electrode voltage for displaying all-pixel in OFF-state) according to the liquid crystal AC driving signal M. In the first embodiment, since the voltage ±V2 is two times as high as the voltage ±V1 to which liquid crystals quicker, it will be cause for flicker. From this viewpoint, it is preferable that signal voltages in a non-display-line access period be uniformed to the voltages as in the case of a full-screen OFF-display or a full-screen ON-display.

FOURTH EMBODIMENT

Figure 20:
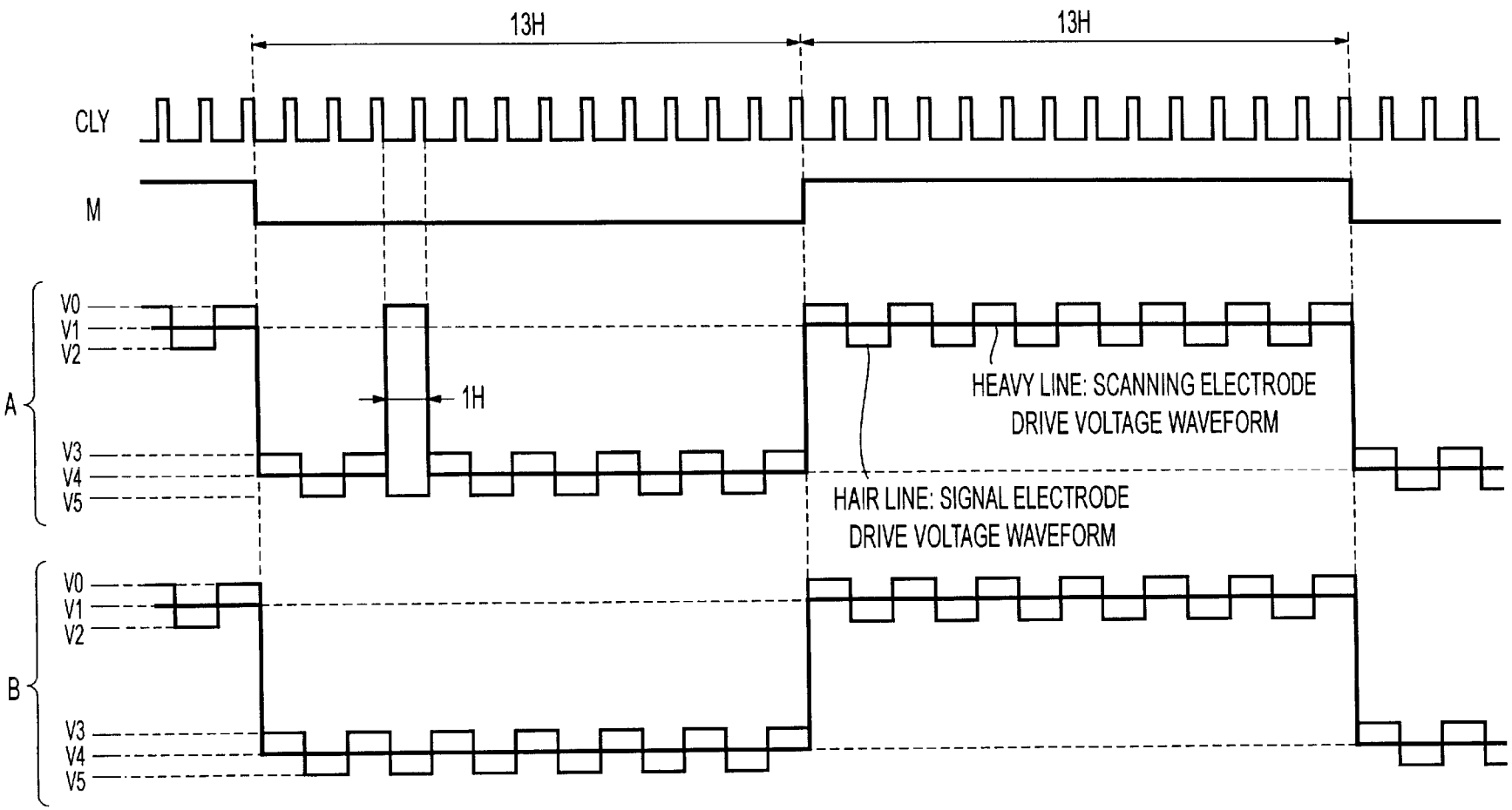
FIG. 20 PRIOR ART
FIG. 20 is a drawing showing driving voltage waveforms of the liquid crystal display apparatus in FIG. 19.
Figure 21:
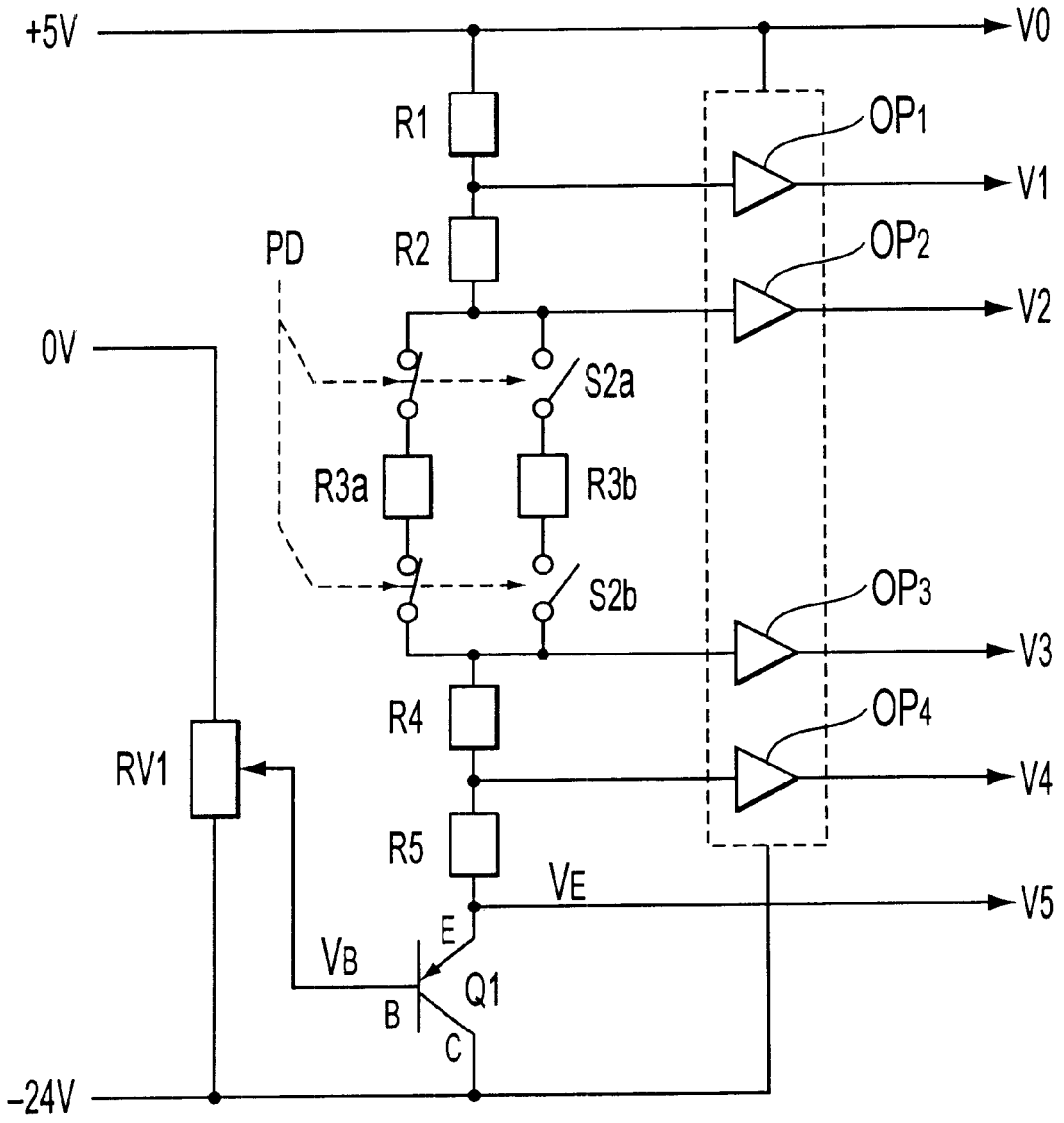
FIG. 21 PRIOR ART
FIG. 21 is a detailed circuit diagram of the driving-voltage forming circuit in FIG. 19.

Hereinbelow, a description will be given of an example case when an SA (smart-addressing) driving method is used to perform the partial display. Construction of the liquid crystal display apparatus is the same as that in FIG. 1 already described. In FIG. 20 showing the conventional driving voltage waveforms, the SA driving method is a driving method in which, for example, the liquid-crystal alternating-current driving signal M entirely reduces driving potentials (V1 to V4) in the H period as much as possible to turn the non-selection voltages to one level, and the scanning electrodes are sequentially selected one by one as in the same case of the conventional driving. First, a description will be given of an example of a driving-voltage forming circuit equivalent to the block 4 in FIG. 1, with reference to FIG. 8, which is a block diagram thereof.

In the same way as in case of the MLS driving method, the SA driving method requires three voltage levels, which are the non-selection voltage VC, the positive-side selection voltage VH, and the negative-side selection voltage VL. VH and VC are symmetrical with each other with respect to VC as the center. VH with the SA driving method is considerably higher than VH with the MLS driving method. For signal voltages, two voltage levels of ±VX, which are symmetrical with each other with respect to VC as the center, are necessary. A circuit in FIG. 8 uses (Vcc−GND) as an input power-source voltage and uses a data latch signal LP as a clock source of a charge-pump circuit to output the foregoing voltages. Hereinbelow, as long as no particular notes will be given, a description will be made with an assumption for GND to be a reference (0 V) and an assumption of Vcc=3 V.

For a −VX and a VX, GND and Vcc are used as they are, respectively. A block 7 represents an boosted voltage-boosting/voltage-dropping clock forming circuit that forms a 2-phase clock having a smaller time gap to operate the charge-pump circuits 18 to 20 from the data latch signal LP. A block 19 represents a 1/2-voltage-dropping circuit that forms a voltage VC≈1.5 V, which is a voltage reduced from the input power source voltage Vcc by half. A block 18 represents a negative-direction eightfold voltage-boosting circuit that forms a voltage VEE≈−21 V with the (Vcc−GND) as the input power source voltage, which is an eightfold voltage of an input power source voltage in a negative direction on a basis of VCC. A block 21 represents a contrast adjustment circuit that retrieves a necessary negative-side selection voltage VL (for example, −17 V) from VEE. A block 20 represents a twofold voltage-boosting circuit for forming the positive-side selection voltage VH, which forms VH (for example, 20 V) with (VC−VL) as the input voltage, which is a twofold voltage of the input voltage in the positive direction on a basis of VL.

As described above, voltages necessary for the SA driving method can be formed. Any one of the blocks 18 to 20 is a voltage-boosting/voltage-dropping circuit using a charge-pump method. As described above, the charge-pump circuit is formed of serial-connection/parallel-connection switches using a 2-phase clock for plural capacitors. Since a driving-voltage forming circuit according to such a voltage-boosting/voltage-dropping circuit of the charge-pump method provides a higher power-supply efficiency, the liquid crystal display apparatus can be driven by the SA driving method with less power consumption.

Figure 9:
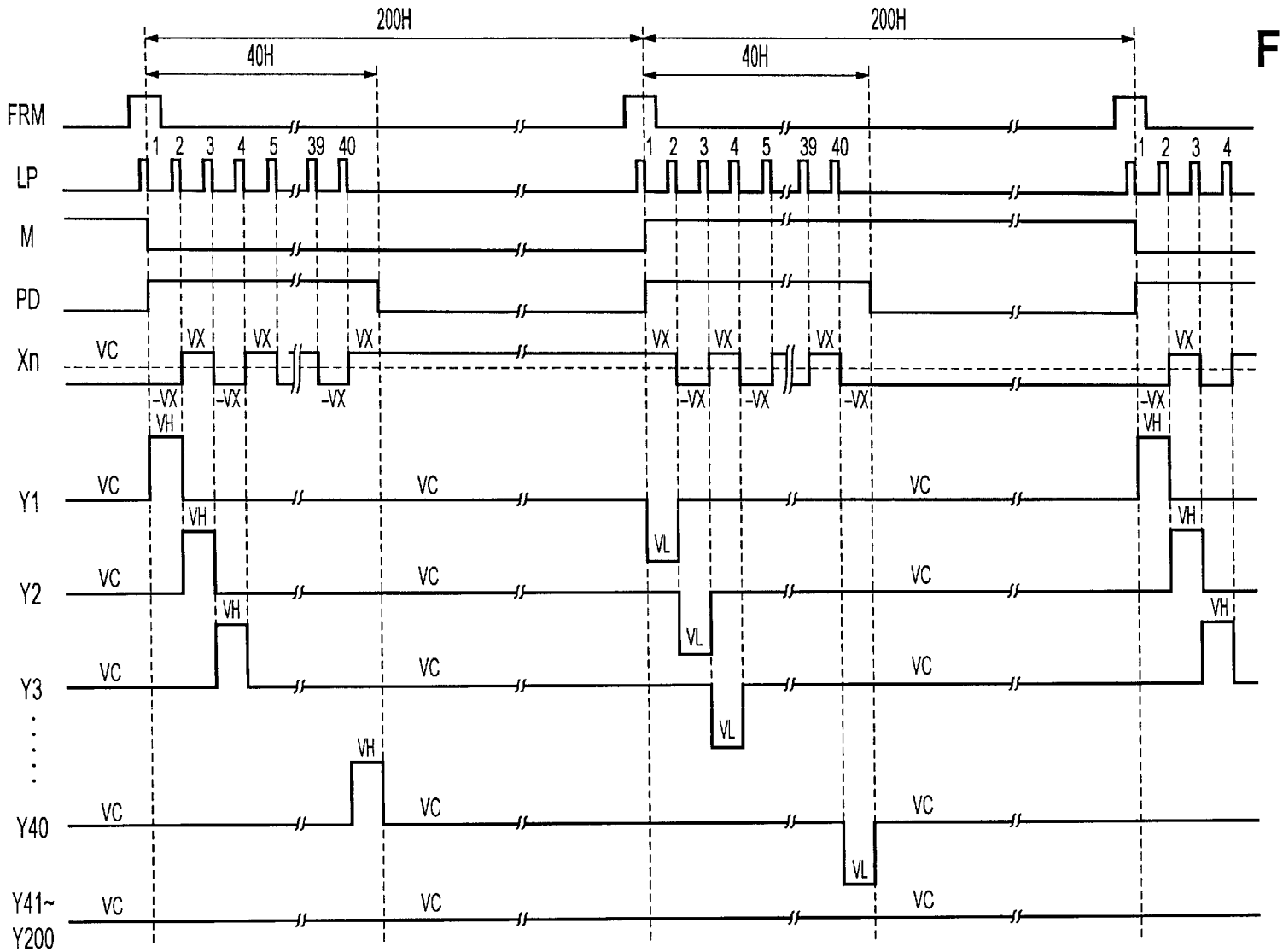
FIG. 9 shows timing charts according to another embodiment of the present invention.

FIG. 9 shows example timing charts including liquid-crystal driving-voltage waveforms of the liquid crystal display apparatus. The example in FIG. 3 represents a case in which a full screen is composed of 200 scanning lines in total and only 40 lines thereof are in a display state, and in the displayed regions there is displayed a horizontal lines at every other scanning electrode.

The length of the one-frame period is assumed to be 200 H. The cycle of the data latch signal LP is 1 H, and one line of the scanning electrode is sequentially selected on a clock basis. The selection voltage VH or VL is applied to the scanning-electrode lines selected, and the non-selection voltage VC is applied to the other scanning-electrode lines. Waveforms Y1 to Y40 and Y41 to Y200 represent 200 lines of scanning-voltage driving waveforms. Sequential selection is performed for the Y1 at a first clock, the Y2 at a second clock, . . . , and the Y40 at a fortieth clock, thus performing one round selection for the 40 lines in 40 H. In a period in which the 40 lines are being selected, a partial display control signal PD is maintained at an H level. Upon completion of selection for the 40 lines, the partial display control signal PD is turned to an L level and is maintained at the L level in the remaining 160-H period. Normally, the Y driver 2 has a control terminal that fixes asynchronously every output at the non-selection voltage VC. As a result of input of PD to such a control terminal as that of the Y driver 2, all of the 200 scanning-electrode lines become fixed at the non-selection level in a non-display-line access period of 160 H in which PD turns to the L period.

For reference, M represents a liquid-crystal alternating-current driving signal which causes polarity switching for a driving voltage (a difference between a scanning voltage and a signal voltage) applied to the pixel liquid crystal according to the H level and the L level. Xn represents a signal electrode driving waveform applied to an n-th signal electrode in the case where a horizontal line is displayed in every other scanning electrode line in a displayed region when only the lines 1 to 40 are in the display state and the lines 41 to 200 are in the non-display state.

FIG. 9 shows a case when polarity of the liquid-crystal driving voltage is inverted on a one-frame basis. The selection voltage applied to the scanning electrode is VH when the liquid-crystal alternating-current driving signal M is at L, while it is VL when liquid-crystal alternating-current driving signal M is at H. The signal voltage is the −VX with ON-pixels and the VX with OFF-pixels when the liquid-crystal alternating-current driving signal M is at L, while it is the VX with ON-pixels and −VX with OFF-pixels when the liquid-crystal alternating-current driving signal M is at H. As described in the above embodiment sections, with fewer partial-display lines and a larger non-display region, in a comparatively long non-display-line access period after the display region is driven at a higher duty, potentials of the signal electrodes and the scanning electrodes are fixed and the polarity inversion is performed in each frame. However, as a result of an experiment, no problem occurred with image quality. Furthermore, it is preferable from the viewpoint of reduction of power consumption for the following reason. In the non-display-line access period, because of fixation of the liquid-crystal driving voltage, power consumption due to charging and discharging current and passing-over current that would be generated due to voltage variation in liquid crystal layers, the Y driver 2 and the X driver 3, and the controller 5 is much smaller. The larger the non-display region, the longer the non-display-line access period and also the longer the period of fixation of the scanning voltages and the signal voltages; by which charging and discharging in the liquid crystal and circuits are reduced to allow less power consumption.

For the voltage applied to the signal electrode Xn in the non-display-line access period, the voltage (VX in FIG. 9) at the time when the scanning electrode of the last line (Y40) in the display region is selected is maintained as it is. Although the signal voltages in the non-display-line access period are fixed at a constant voltage within one field, they are individually switched between VX and −VX on a frame bases. In this way, the signal voltages in the non-display-line access period do not need to be the same potentials in the individual frames. In such a manner, the signal voltages in the non-display-line access period are alternately repeated with the two potentials that are symmetric each other with respect to the non-selection voltage VC as a reference. By this, effective voltages to be applied to the liquid crystal in a display region can be fixed to be the same in either cases of the full-screen display state or the partial display state so that a contrast in a display region can remain unchanged when the full-screen display state and the partial display state are switched therebetween. The VX or the −VX in this embodiment is equivalent to the signal electrode voltage in the case of the full-screen OFF-display and the full-screen ON-display; therefore, as in the same case as the embodiments described earlier, the construction is made so that the potentials of the signal electrodes are fixed in the non-display-line access period at the same levels as those in the full-screen ON-display or the full-screen OFF-display.

For reference, to form the signals PD and LP, a circuit such as that in FIG. 5 may be used. For time charts in this case, modifications as described below are incorporated in to the FIG. 6. That is, modifications are made for: CA to FRM, the fn length to a one-frame period (200 H), the number of clocks of LPI in one-frame period to 200, the H period of the CNT to the period from rising at the LPI 200th clock to falling at the 40th clock, the LP clocks from the LPI first clock to the 40th clock, and the H period of PD to the period from rising at the LPI first clock to falling at the 41st clock.

According to the aforementioned manners, a partial-display function with the SA driving method can be implemented. These manners also allow power consumption in the partial display state to be reduced to an extent substantially in proportion to the number of display lines.

For reference, in the full-screen display state, the control signal PD is usually at the H level and the data latch signal LP is continuously fed so that the scanning electrodes Y1 to Y200 are sequentially selected. Furthermore, in the full-screen display state, the polarity inversion must be performed in each predetermined period. For example, the polarity inversion must be performed in a manner that polarity-switching for the selection voltages and the signal voltages are performed therebetween at every 13 H. As an alternative manner, the polarity inversion of the liquid-crystal driving electrodes may be performed in every frame period, or the polarity inversion may be performed in every predetermined period in a frame.

Furthermore, in the case of the full-screen display and in the case of the partial display on partial lines, application time and voltage of the selection voltages for the individual scanning electrodes are the same. Therefore, there is no additional element necessary for the driving-voltage forming circuit because of the partial-display function, and the number of the partial-display lines can be set in software mode.

FIFTH EMBODIMENT

Figure 8:
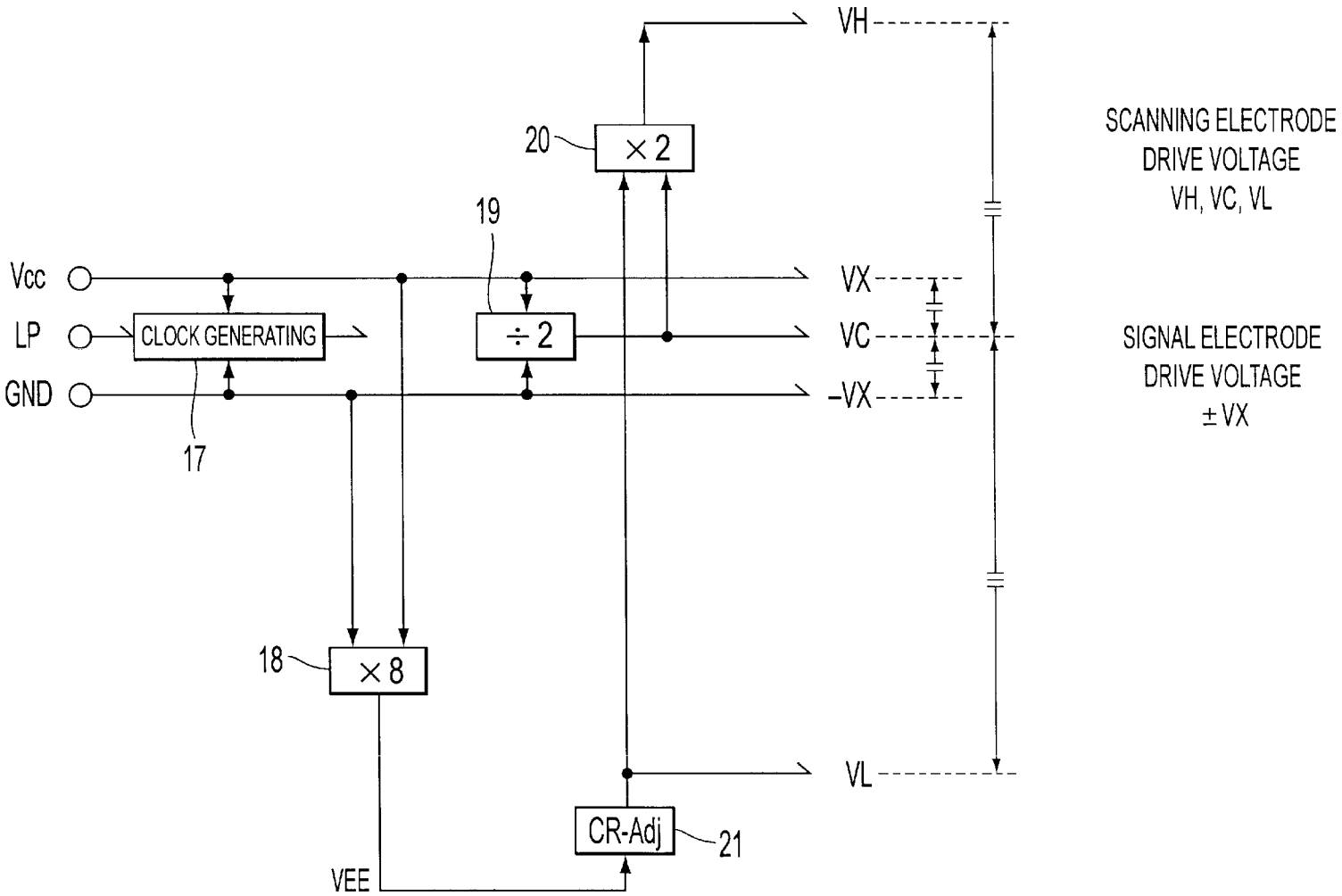
FIG. 8 is a block diagram of a liquid crystal driving-voltage forming circuit to be used in another embodiment of the present invention.

This embodiment is different from the fourth embodiment in an aspect in which timings of the liquid-crystal alternating-current driving signal M in a period when selection voltages are applied to display lines are the same in the case of the full-screen display and in the case of the partial display on partial lines. This embodiment is the same as the fourth embodiment in that it adopts the SA driving method and as shown in FIG. 8, the driving-voltage forming circuit 4 mainly constituted of the charge-pump circuit; a full screen has 200 lines of the scanning electrodes and only 40 of the 200 lines are in the display state; it is an example case in which the horizontal line is displayed at every other scanning electrode in the display state portions; the length of the one-frame period is 200 H; the application voltage for the scanning electrodes in the non-display-line access period is fixed at the non-selection voltage VC, and the application voltages for the signal electrodes are fixed at VX or −VX which are symmetrical with each other with respect to VC; the selection voltages applied to the scanning electrodes are at VH when the liquid-crystal alternating-current driving signal M=L, and are at VL when M=H; and the signal voltages are at the −VX with ON-pixels and are at VX with OFF-pixel when M=L, and are at VX with ON-pixels and are at the −VX with OFF-pixels when M=H. Therefore, descriptions regarding the same portions as those in the fourth embodiment will be omitted.

Figure 10:
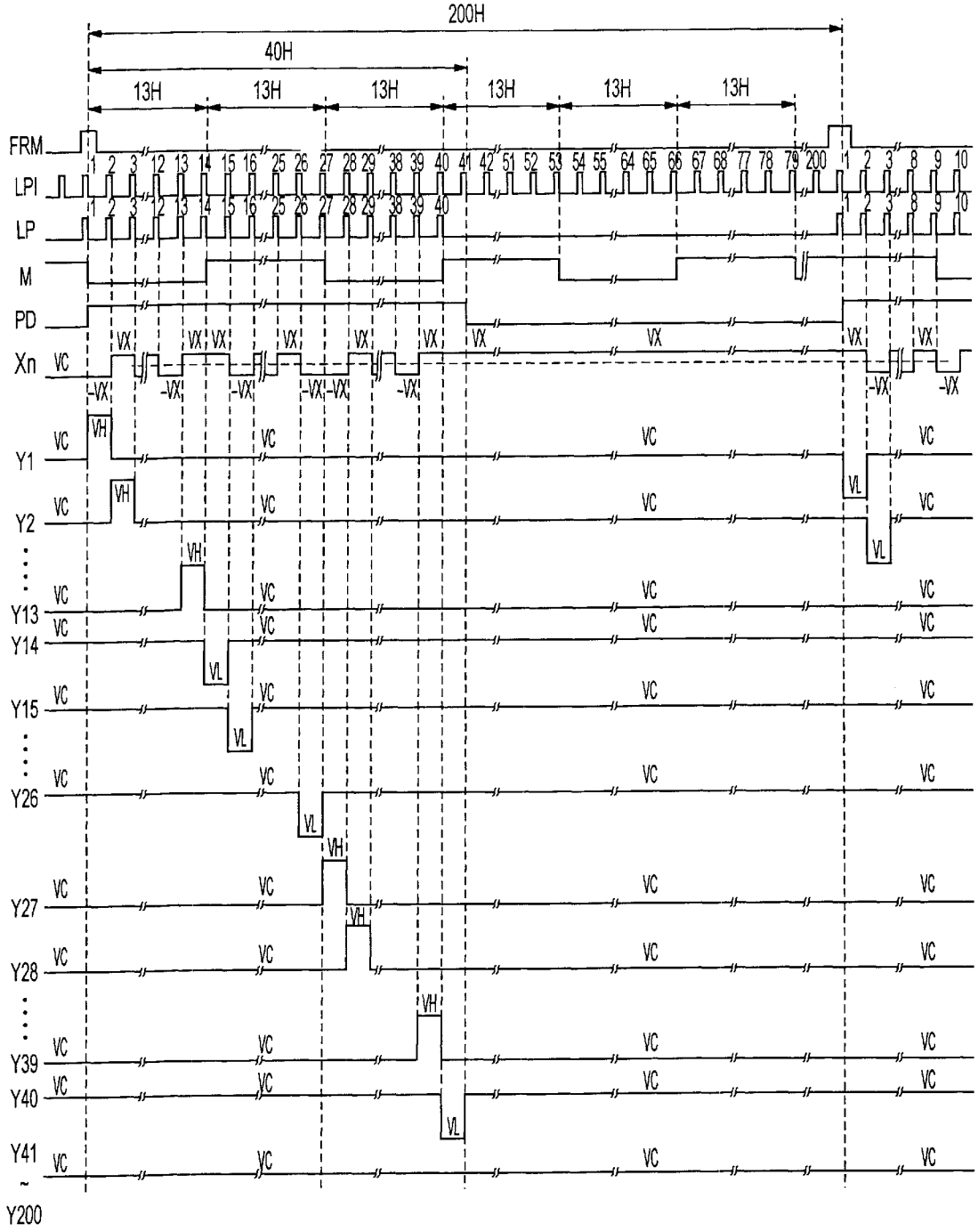
FIG. 10 shows timing charts according to another embodiment of the present invention.

FIG. 10 shows timing charts in this embodiment, indicating that polarity-switching for the liquid-crystal driving voltage are performed therebetween at every 13 H (a selection period of 13 lines of the scanning electrodes). This makes the cycle of the liquid-crystal alternating-current driving signal M to be 26 H. The period 200 H cannot be divided by 26 H; therefore, timing of the liquid-crystal alternating-current driving signal M for the frame start signal FRM deviates by 8 H per frame, and the it returns to the original timing in FIG. 10 after one round for 13 frames.

To form the liquid-crystal alternating-current driving signal M of a constant cycle in the partial display state, the continuous clock signal LPI in FIGS. 5 and 6, which is a component of LP, is divided into a half cycle and then further divided into another half cycle. The case of the full-screen display is not illustrated, but in the same manner as in the case of the partial display, polarity-switching for the liquid-crystal driving voltage is assumed to be performed every 3 H. In this way, timing of polarity inversion of voltages applied to the liquid crystal in a display portion in the partial display can be arranged to be the same as that in the case of the full-screen display state.

By the above arrangement, an image quality of the display portion in the partial display state can be arranged to the same as that in the case of the full-screen display. For reference, when LP, not a serial clock signal LPI, is used to form the liquid-crystal alternating-current driving signal M, flicker may occur or image quality may be degraded with DC voltage application in the partial display state, because of the relationship between the polarity-inversion cycle of driving voltages and the number of partial-display lines.

SIXTH EMBODIMENT

Figure 11:
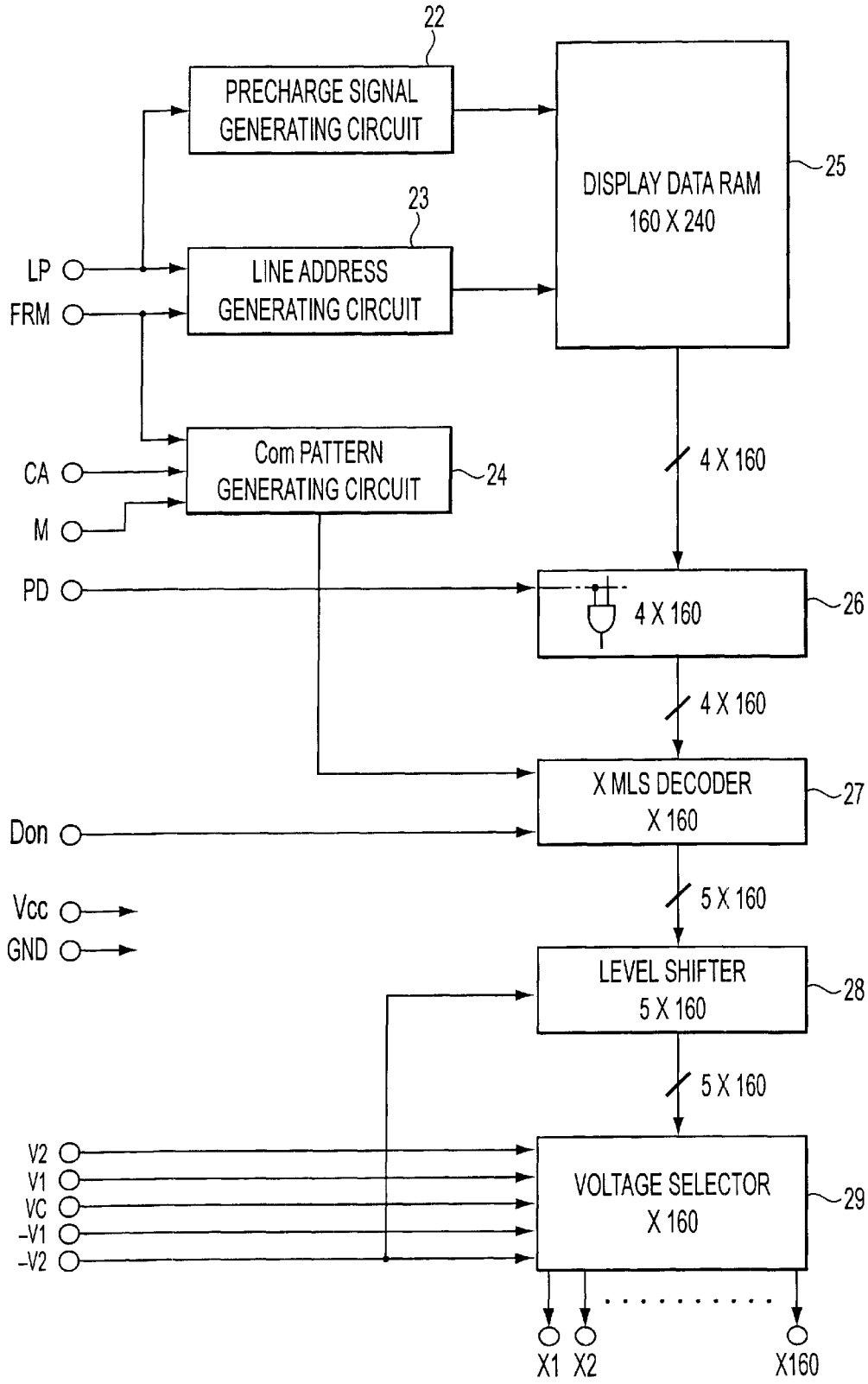
FIG. 11 is a fragmentary block diagram of a signal-electrode driving circuit according to the embodiment of the present invention.

FIG. 11 is an example partial block diagram showing the signal-electrode driving circuit (X driver 3) in FIG. 1. It corresponds to the 4MLS driving method, for which the number of output terminals for liquid-crystal driving is assumed as 160 as an example. Hereinbelow, construction and functions of the individual blocks in FIG. 11 will be described.

A block 25 represents a RAM to store display data, which is formed of the number of bits (for 160×240 pixels) so as to correspond to a liquid crystal display panel of up to 240 lines for binary display (display in only ONs/OFFs, without gradation display). A block 22 is a circuit to generate signals that precharge the RAM 25 according to the data latch signal LP. A block 23 is a line address generation circuit to specify which four lines of display data will be read out from the RAM 25; addresses thereby sequentially specified according to the frame start signal FRM and the data latch signal LP corresponds to four lines of the scanning electrodes simultaneously selected, and the addresses of four lines are sequentially incremented so that display data for pixels corresponding to 4 lines×160 columns are output in batch.

The four lines of display data which have been specified by the line address generation circuit 23 are read out from the RAM 25 and the read data are sent to a readout display data control circuit in a block 26. In a period when the partial display control signal PD is at the H level, the same contents as that of display data are sent to the next block 27 through the block 26; however, in a period when the partial display control signal PD is at the L level, the display data from the RAM is ignored, but all-pixel-OFF data (0) are sent to the block 27. Here, in the period when PD is at the L level, the block 26 may be changed such that all-pixel-ON display data (1) is input to the block 27.

A block 24 is a circuit to generate Com patterns according to frames, fields, or polarity of liquid crystal driving voltages, as shown in FIG. 4A, by which Com patterns are stored in a ROM or the like and are addressed by the frame start signal FRM, the field start signal CA, the liquid-crystal alternating-current driving signal M, and the like, and Com patterns corresponding to polarity-switching for liquid-crystal driving voltages (the patterns are inverted according to the level of M) are selected and outputted. The block 27 is an MLS driving method decoder for the X driver, which forms the driving-voltage selection signals from the Com patterns and four lines of the display data via the block 26. From the MLS decoder 27, the driving-voltage selection signals, of which five lines covers one pixel, are outputted to cover 160 pixels. The driving-voltage selection signals are sets of signals, each set having five lines, which specifies a voltage to be selected from five voltages, which are VC, the ±V1, and the ±V2. Don denotes a display control signal for turning a full screen to be in a non-display state. Turning Don to the L level causes only a signal specifying selection of VC from the five selection signals to be active; while turning Don to the H level causes signal voltages determined according to the determinant in FIG. 4C to be selected from five voltages in accordance with display data and Corn patterns which are displayed on pixels for four lines in the column direction.

A block 28 represents a level shifter that is to increase the voltage amplitude of the driving-voltage selection signals from a logic voltage (Vcc−GND) to a liquid-crystal driving voltage level (V2−[−V2]). A block 29 represents a voltage selector that is to actually select one voltage from the five voltages VC, ±V1, and ±V2, by which one of switches connected to feed lines of the five voltages is closed according to the driving-voltage selection signals of which the voltage amplitude levels are increased, selected voltages are outputted to individual signal electrodes X1 to X160. The above are the construction of the block diagram in FIG. 11 and the functions of the individual blocks therein.

In the non-display-line access period of the partial display state, when a clock of the data latch signal LP is closed and the signal is inputted to an LP terminal of the X driver 3 of this embodiment, as shown in FIG. 3, a precharge-signal generation circuit of the block 22 and the line address generation circuit of the block 23 can be stopped; that is, readout operations of the RAM 25 can be stopped in the period. In this case, because the line address generation circuit 23 is not inputted with LP and addresses are not incremented, the RAM 25 continue to output the last four lines of the display data to the display region.

Therefore, when the block 26 is omitted, as in the first embodiment, the signal voltages in the non-display-line access period continue at the voltages at the time when the last four lines of the scanning voltages in the display region are selected. However, as shown in FIG. 11, with the block 26, when the signal PD, as shown in FIG. 3, which turns to L is inputted to PD terminal of the X driver 3 in the non-display-line access period, the signal voltages in the non-display-line access period are maintained to be the same voltage (V1 or −V1) as the signal voltages in the case of the full-screen OFF-display or the full-screen ON-display, as in the case of the fourth embodiment.

The RAM-built-in type driver for storing data to be displayed on full screens is used because it is effective for making the liquid crystal display apparatus to be a less power consumption type. Furthermore, with the MLS driving method of the selection-voltage equal distribution type as described in the first embodiment, the RAM-built-in type driver makes construction of the liquid crystal display apparatus easier. For these reasons, for liquid crystal display apparatuses intended for both image quality improvement and less power consumption, such RAM-built-in type drivers suitable for the MLS driving method have become to be adopted. In such a liquid crystal display apparatus, power consumption because of a precharging (refreshing) operation performed in readout of display data from a RAM accounts for a considerable part of the entire power consumption. Therefore, for the pursuit of less power consumption by means of a partial display function, the X driver such as that used in this embodiment needs to be used to stop the RAM-readout operations in the non-display-line access period.

In the above embodiment, the case in which the MLS driving method performs four-line simultaneous selection has been described; however, the number of the simultaneous selection lines is not limited to four and it may be 2, 7, or the like. Furthermore, although the case in which application of the selection voltages is equally distributed within one frame has been described, a case in which such equal distribution is not performed(in case that selection period in a frame for one scanning electrode is continuous) is also applicable. Furthermore, in FIG. 11, a V2 terminal and a VC tenninal are arranged independently of Vcc and GND, which are logic section power source terminals; however, they may not be arranged independently. Furthermore, this invention is also applicable in liquid crystal display apparatuses such as those in which gray scale display, not binary display, can be performed, and a display data RAM possesses storage capacity corresponding to the number of gray scale bits; and in which display data RAMs for plural screens are included, and screens can be switched for display.

SEVENTH EMBODIMENT

Figure 12:
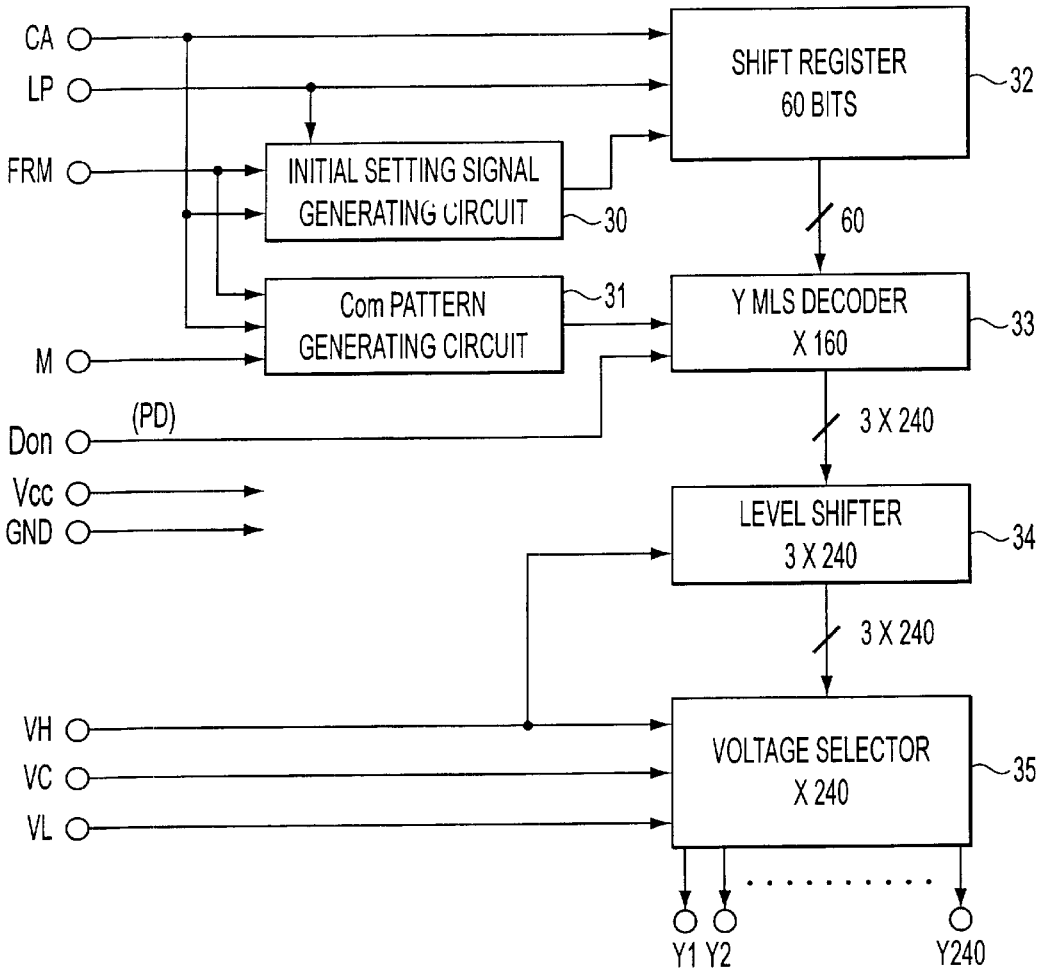
FIG. 12 is a block diagram of a scanning-electrode driving circuit according to the embodiment of the present invention.

FIG. 12 is an example block diagram showing the scanning-electrode driving circuit (Y driver 2) in FIG. 1. In the same way as in the sixth embodiment, it corresponds to the 4MLS driving method, for which the number of output terminals for liquid-crystal driving is assumed as 240 as an example. Hereinbelow, construction and functions of the individual blocks in FIG. 12 will be described.

A block 32 represents a shift register to sequentially transfer the field start signal CA bit by bit by using the data latch signal LP as a clock. It is formed of 60 bits and it specifies which four lines of the 240 lines will be applied with selection voltages. A block 30 is an initial-setting-signal generation circuit for generating a signal that is to set the first bit of the shift register 32 to 1 and resets the remaining 59 bits so as to be 0 with timing of falling of the data latch signal LP at a time when the frame start signal FRM and the field start signal CA are at the H level. In the same way as in the Com-pattern generation circuit 24 in FIG. 11, a block 31 is a circuit to generate Com-patterns according to field and polarity of a liquid crystal driving voltage, by which Com-patterns are stored in a ROM or the like and are addressed by the frame start signal FRM, the field start signal CA, the liquid-crystal alternating-current driving signal M, and the like, and Com-patterns corresponding to polarity for liquid-crystal driving voltages are selected and outputted. The Com-pattern generation circuits of the X driver 3 and the Y driver 2 may be shared by either one thereof. A block 33 is an MLS driving method decoder for the Y driver, which forms three lines of the driving-voltage selection signals from the Com-patterns and selection-line information of 60 bits, which is specified in the shift register 32. From the MLS driving method 33, the driving-voltage selection signals, of which three lines covers one line, are outputted to cover 240 lines. The driving-voltage selection signals are sets of signals, each set having three lines, which specifies a voltage to be selected from three voltages, which are VH, VC, and VL.

Don denotes a display control signal for turning a full screen to be in a non-display state. Turning Don to the L level causes only a signal specifying selection of VC from the three selection signals to be active; while turning Don to the H level causes signal voltages determined according to the determinant in FIG. 4C to be selected from the three voltages.

A block 34 represents a level shifter that is to increase the voltage amplitude of the driving-voltage selection signals from a logic voltage (Vcc−GND) to (VH−VL). A block represents a voltage selector that is to actually select one voltage from the three voltages VH, VC, and VL. By this block 35, one of switches connected to feed lines of the three voltages is closed according to the driving-voltage selection signals of which the voltage amplitude levels are increased, and selected voltages are outputted to individual scanning electrodes Y1 to Y240. The above are the construction of the block diagram in FIG. 12 and the functions of the individual blocks therein.

In the non-display-line access period of the partial display state, when the data latch signal LP of which a clock is closed, as shown in FIG. 3, is inputted to an LP terminal of a Y driver 2 of this embodiment, the operation of the shift register 32 can be stopped. It is preferable that the operation of the shift register 32 is stopped as described above for the pursuit of less power consumption in the partial display state, although power consumption by the Y driver is comparatively less.

The initial-setting-signal generation circuit of the block 30 is provided for the reason that abnormal display is avoided with timing of transition from the partial display state to the full-screen display state. In the partial display state without such a block 30, when an operation is performed with the timing in FIG. 3 or 7, the H level is unexpectedly written to the shift register 32 at every 10 bits. Even so, since no rise is given to a problem because bits after 10 bits are ignored by the signal PD in the partial display state. However, when this state is shifted to the full-screen display state, selection voltages are unexpectedly applied concurrently to four lines of the selection voltages at every 40 lines and to 20 of 200 lines in the case of the full screen, causing abnormal display. For reference, instead of the arrangement with the block 30, an arrangement may be such that an initial setting circuit is added to reset the shift register 32 when PD is at L and the bits in the shift register 32 are reset to the initial state at the time of transition from the partial display state to the full-screen display state. That is why, a means to initialize the shift register at the time of transition from the partial display state to the full-screen display state is necessary.

EIGHTH EMBODIMENT

Figure 13:
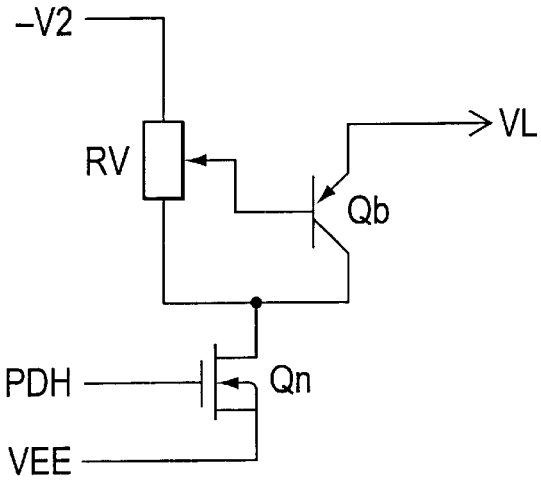
FIG. 13 is a circuit diagram of a contrast adjustment circuit according to the embodiment of the present invention.

FIG. 13 shows an example circuit diagram of the contrast adjustment circuit 13 of the present invention, as shown FIGS. 2 and 8. RV denotes a variable resistor, Qb denotes a bipolar transistor, and Qn denotes an n-channel MOS transistor. A signal PDH inputted to a gate of the Qn is a signal formed of the signal PD of which the voltage amplitude has been increased by a level shifter from the logic voltage (Vcc−GND) to (Vcc−VEE). As compared to a resistance value of RV, a resistance value of the transistor Qn is assumed to be smaller so as to be ignored. In the figure, for example, the −V2 is −3 V, VEE is −15 V, and VL is −10 V.

Figure 16:
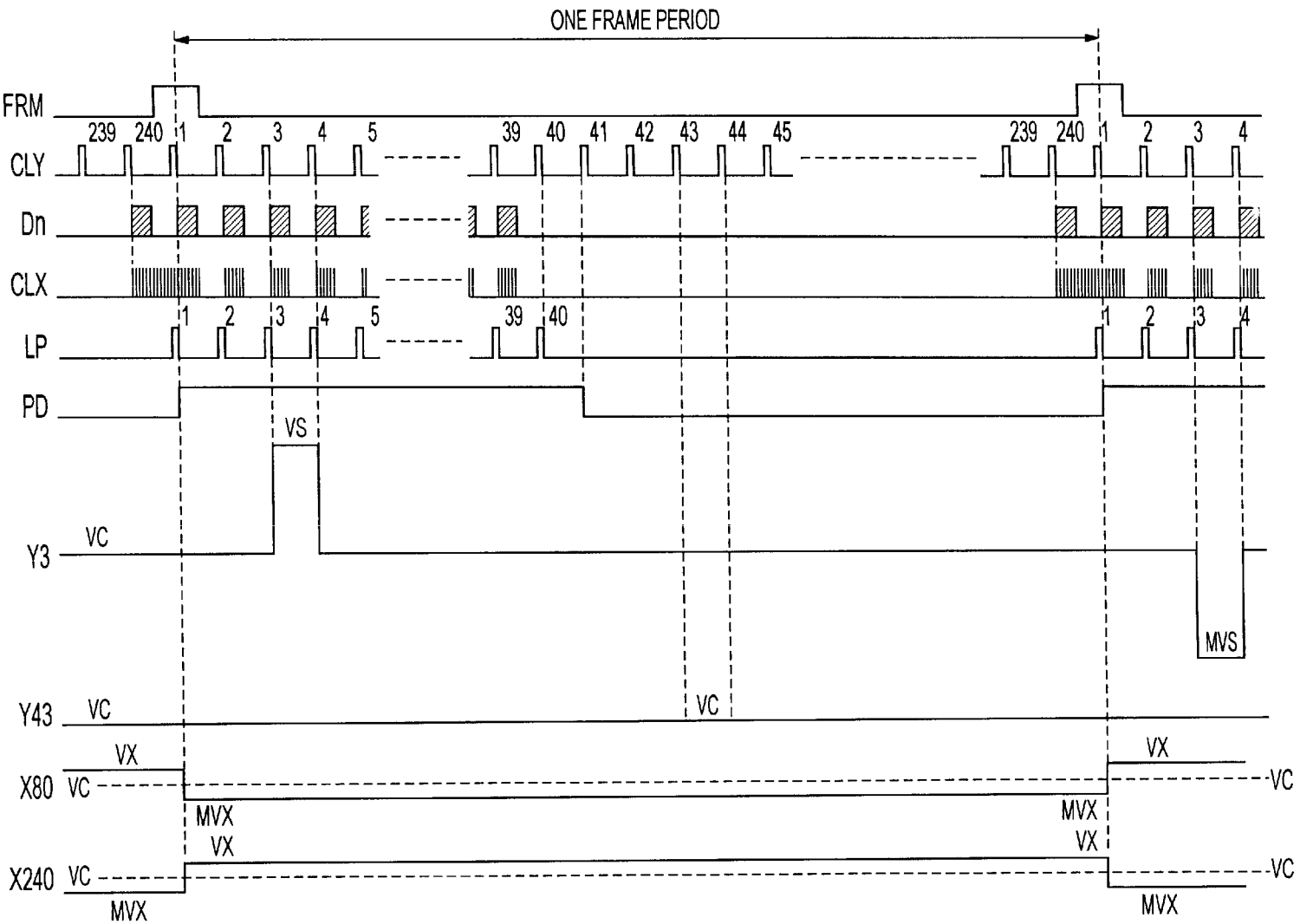
FIG. 16 shows timing charts representing operations of the liquid crystal display apparatus in FIG. 15.

If the transistor Qn is omitted, the contrast adjustment circuit transistor is basically the same as the conventional contrast adjustment circuit section in FIG. 16. In the full-screen display state, PDH is always at the H level, that is, the Qn is always ON; and since existence of the Qn can be ignored with respect to the resistance value, the contrast adjustment circuit functions in the same manner as the conventional contrast adjustment circuit. A voltage formed by division between the −V2 and VEE is retrieved by the variable resistor, the retrieved signal is fed to the base of the Qb, and the Qb feeds a voltage which is 0.5-V higher than the voltage fed to the base thereof from an emitter as VL. Adjustment of the variable resistor RV provides the selection voltage VL which will result in a most suitable contrast. A period in which PDH is at the H level, that is, a period in which the selection voltages are applied, is the same in the partial display state, too.

In a period when PDH is at the L level, that is, in the non-display-line access period, the Qn turns OFF to stop the function of the contrast adjustment circuit 13. In this period, the base of the Qb and a collector turn to be of the same potential as the −V2, by which the Qb also turns OFF completely. In this period, the charge-pump circuit of the driving-voltage forming circuit 4 is in an operation-stopped state, and application of the selection voltages is also in a stopped state; therefore, VL-related consumption current is 0. In this case, since voltage is maintained, no problem occurs. In this way, by stopping the contrast adjustment circuit 4 in the non-display-line access period, power consumption with the contrast adjustment circuit in the stopping period can be made to 0, allowing reduction of power consumption with the liquid crystal display apparatus.

In the above embodiment, a case in which the signal PDH formed of the level-shifted PD is necessary has been described; however, modification of the construction of the driving-voltage forming circuit enables the contrast adjustment circuit to be stopped by directly using the partial display control signal PD, not using the level-shifted PDH.

In this way, according to the first to eighth embodiments, there can be provided an electrooptical apparatus of higher general usability which allows setting of the number of display lines by software without complication of a driving voltage forming circuit. Furthermore, there can be provided an electrooptical apparatus greatly reducing power consumption at a partial display time.

For reference, in the above individual embodiments, although signal voltages in the non-display-line access period are fixed within one field or are fixed in a predetermined period shorter than one frame. However, when the voltage fixation is made at least in a period longer than a driving period of the same polarity (a half cycle of a polarity inversion driving cycle) in a polarity inversion in the cycle of liquid crystal driving in the full-screen display state, power consumption can be implemented; and in this case, an arrangement may be such that the polarities are inverted by signal voltages used at the full-screen ON-display and at the full-screen OFF-display according to the predetermined period in the non-display-line access period. For example, with a simple-active-matrix type liquid crystal display apparatus, since the liquid-crystal-driving polarity inversion in the full-screen display state is performed at every 11 H or 13 H, the polarity inversion driving cycle is 22 H or 26 H. In an active-matrix type liquid crystal display apparatus such as that to be described later, since the polarity inversion is performed at every 1 H or dot period (=1 H/number of horizontal pixels), the polarity inversion driving cycle is 2-H or 2-dot period. The polarity inversion driving cycle in the partial display state is arranged to be larger than these cycles in the full-screen display state, application voltages are fixed at least in a period longer than 11 H or 13 H in the case of the simple-active-matrix type liquid crystal display apparatus, and application voltages are fixed at least in a period longer than 1 H or the dot period in the case of the active-matrix type liquid crystal display apparatus. In this case, the driving frequency is reduced to allow less power consumption.

Figure 22:
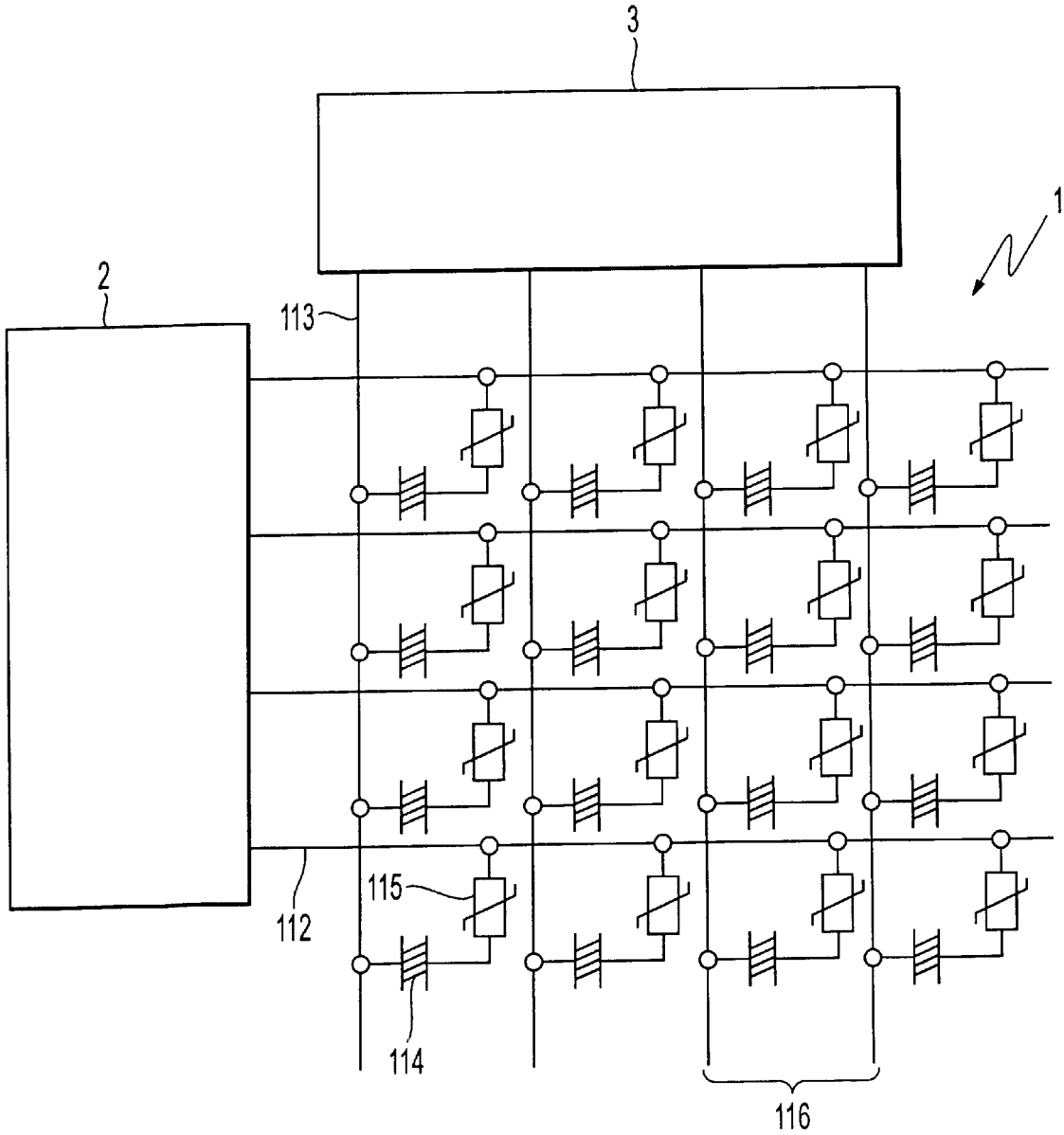
FIG. 22 is an equivalent circuit diagram of pixels of an active-matrix type crystal display panel having two-terminal type nonlinear elements on the pixels.

For reference, while the first to eighth embodiments have been described on the basis of a simple-matrix type liquid crystal display apparatus as an example, this invention may be applied to an electrooptical apparatus, such as an active type liquid crystal display apparatus having two-terminal type nonlinear elements for pixels. FIG. 22 is a drawing showing an equivalent circuit diagram of such an active-matrix type liquid crystal display apparatus 1, in which 112 denote scanning electrodes, 113 denotes signal electrodes, 116 denotes pixels, 3 denotes an X driver, and 2 denotes a Y driver. Each of the pixels 116 is formed of a two-terminal type nonlinear element 115 and a liquid crystal layer 114 that are electrically connected in series between the scanning electrode 112 and the signal electrode 113. The connection order of the two-terminal type nonlinear element 115 and the liquid crystal layer 114 which is shown in the drawing may be opposite. In either way, it is used as a switching device utilizing its voltage-current characteristics as being of non-linear relative to application voltages between two terminals as a thin-film diode. As a construction of a liquid crystal display panel, on one substrate there are formed the two-terminal type nonlinear elements and pixel electrodes and either the scanning electrodes or the signal electrodes with wide width, on another substrate there are formed the other so as to overlap with the pixels, and the liquid crystal layer is sandwiched between the paired substrates. In such an active-matrix type liquid crystal display panel, the partial display can also be performed in a similar manner to the driving methods of the aforementioned embodiments. For reference, with the active-matrix type liquid crystal display panel, the diving method is performed such that the switching devices are arranged for the individual pixels to retain voltage. Therefore, as will be described later, it is preferable that when the full-screen display state is to be changed to the partial display state, changing to the partial display state is to be performed after OFF-display voltages are written to the pixels in the non-display region.

NINTH EMBODIMENT

Figure 14:
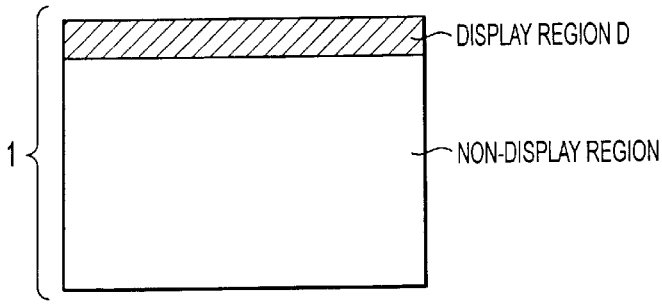
FIG. 14 is a drawing to be used to explain a partial display state in a liquid crystal display apparatus according to the present invention.

This embodiment realizes display which is not incompatible in the partial display. FIG. 14 is a drawing to be used for explaining the partial display state in an liquid crystal display apparatus of this embodiment. The numeral 1 denotes a normally-white type liquid crystal display panel on which, for example, 240 lines×320 columns of pixels (dots) can be displayed. Full-screen display is possible when it is necessary; however, part of the full screen (for example, only upper 40 lines, as shown in FIG. 14) can be in the display state (display region D), and the rest of the region can be in the non-display state (non-display region). Since the panel is the normally-white type, the non-display region is displayed in white.

A construction of the liquid crystal display panel is similar to the first to eighth embodiments, in which a liquid crystal is sandwiched by a pair of substrates, electrodes are arranged on inner surfaces of the substrates to apply voltage to a liquid crystal layer, and polarizing elements are arranged on outer surfaces when they are necessary. Transmissive axes are set differently depending upon the type of liquid crystal and are set so that as well known, display appears in white when an effective voltage to be applied to the liquid crystal is lower than a threshold voltage of the liquid crystal. For reference, as the polarizing elements, they are not limited to polarizers, but may be, for example, polarizing elements that transmit light of specific polarization axes as beam splitters. As the liquid crystal, various types may be used, including the type a liquid crystal molecules are twist-oriented (such as a TN type and an STN type), a homeotropically oriented type, a vertically-oriented type, and a memory type such as a ferroelectric type. Furthermore, a liquid crystal of light-scattering type, such as a polymer-dispersed type, may also be used. In this case, the polarizing elements are omitted and orientation of liquid crystal molecules are set to be the normally-white type. Furthermore, when contrast higher than that in the case of the normally-white type liquid crystal display panel is necessary, a light-shield layer (a light-shield frame between opening sections of adjacent pixels) is arranged.

Furthermore, to make the liquid crystal display panel 1 to be a light-reflective type, a light-reflection plate is arranged on the outside of either one of the substrates, or a light-reflection electrode or a light-reflection layer is formed on an inner surface of either of the substrates, in which when the effective voltage, which is to be applied to the liquid crystal, is lower than a threshold voltage, the orientation axes of the liquid crystal molecules and transmissive axes of the polarizing elements are set so that the foregoing light-reflection member reflects incident light. For reference, in most liquid crystal display panels utilizing the STN liquid crystal, a retardation film is arranged between the liquid crystal and the polarizing element. In such a case, the transmissive axes are set in consideration of the retardation film. To make the liquid crystal display panel to be a transflective type, an illumination unit is arranged to illuminate the liquid crystal display panel; in which when the illumination unit is illuminated, the liquid crystal display panel 1 is used as a transmissive type; when the illumination unit is not illuminated, the panel is used as a reflective type. For arrangement of the transflective type, various manners can be considered, including a manner in which a transflective plate is arranged on the outside of either of the substrates, a manner in which a reflective polarizer that transmits light and, perpendicular thereto, reflects light of a polarization axis component; and a manner in which the electrode to be formed on the inner surface of either one of the substrates is arranged to semi-transmits light (for example, an hole is given).

For arrangement of the liquid crystal display panel 1 to be a color display type, manners can be considered, including a manner in which a color filter is formed on inner surfaces of the substrates in such a case of the reflective type or the transflective type, and a manner in which three colors illuminated by the illumination unit are switched in time series in the case of the transflective type.

In the partial display state of the liquid crystal display panel 1, the effective voltage equal to or lower than an OFF voltage set to be lower than the threshold voltage is applied to the liquid crystal of the non-display region. As described earlier, since the liquid crystal display panel 1 is the normally-white type, the non-display region is displayed in white, as illustrated in the drawing, and an image is displayed in an intermediate gradation or in black in the display region D, allowing the partial display screen without producing an incompatible result.

Figure 23:
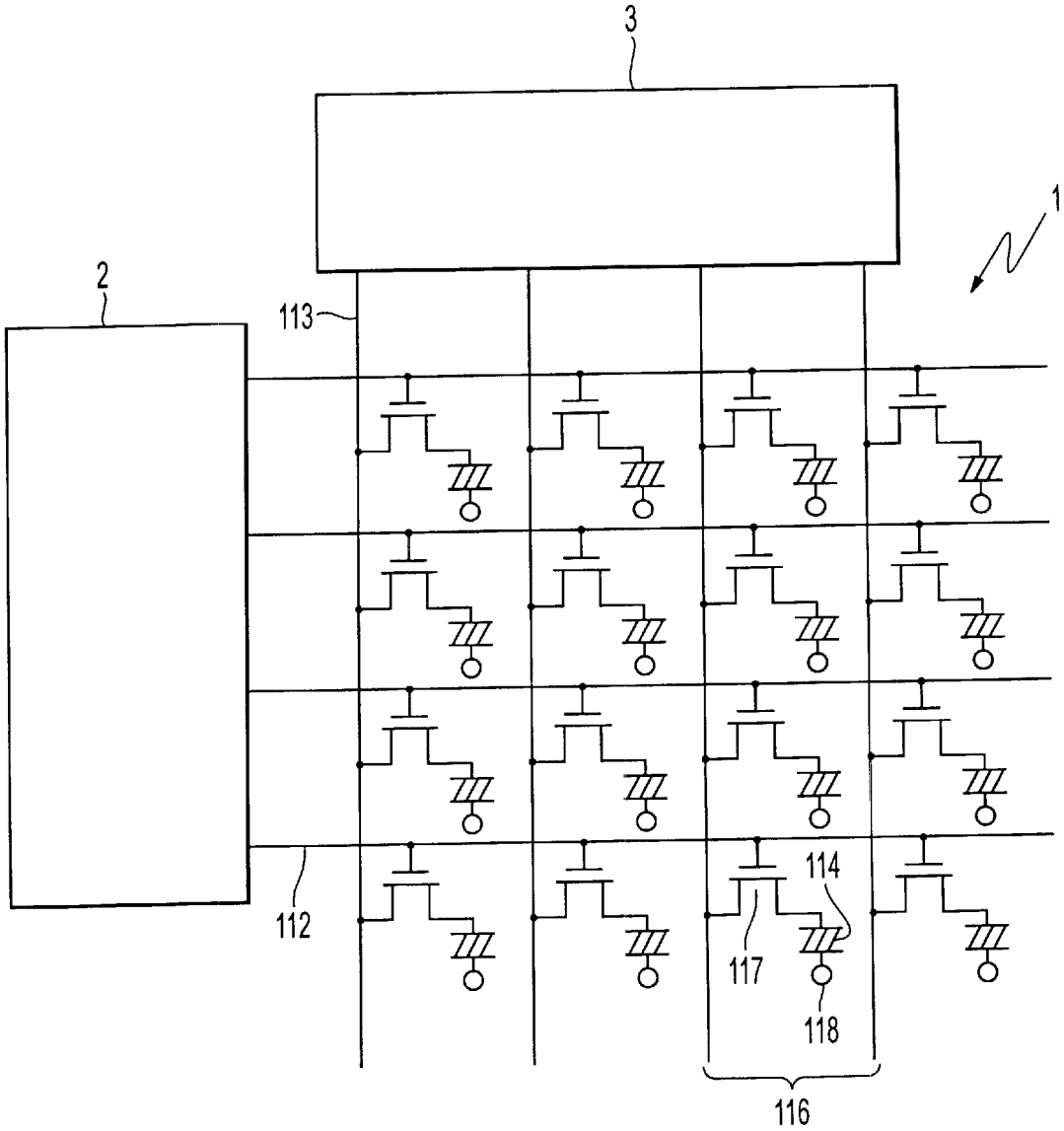
FIG. 23 is an equivalent circuit diagram of the active-matrix type crystal display panel having transistors on the pixels.

For reference, as a construction of the liquid crystal display panel 1, in addition to the aforementioned construction, a construction may be such as that of the active-matrix type liquid crystal display panel, as described with FIG. 22, in which the two-terminal type nonlinear elements are arranged for the pixels, or of an active-matrix type liquid crystal display apparatus, as shown in FIG. 23, in which both the scanning electrodes and signal electrodes are formed in matrix on either one of substrates and transistors are formed for individual pixels.

Figure 15:
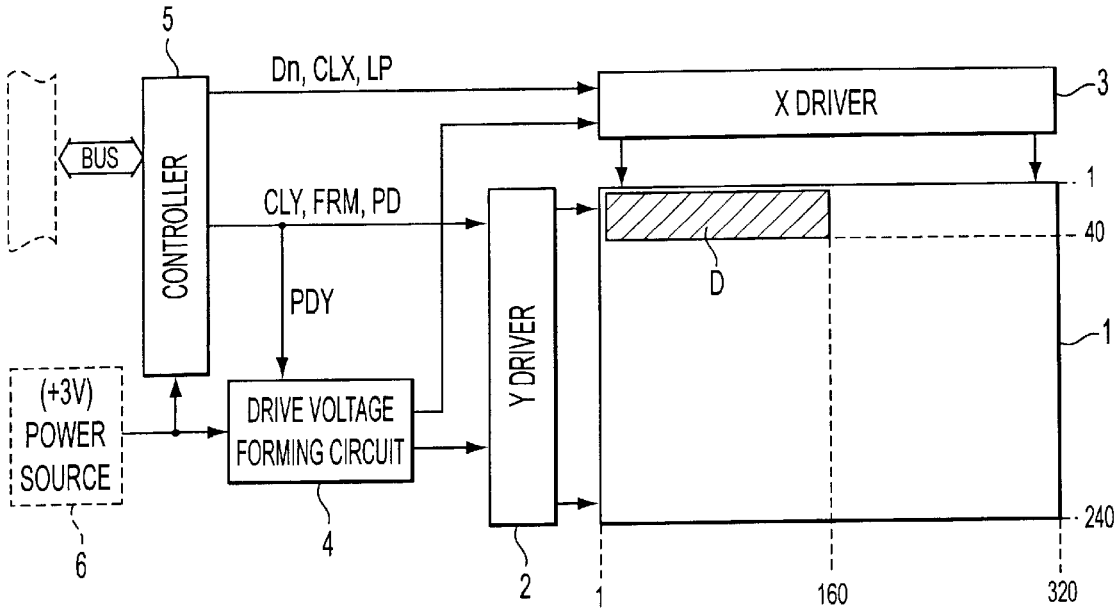
FIG. 15 is a drawing showing an example construction of a liquid crystal display apparatus according to the present invention.

Hereinbelow, a description will be given of a manner to apply the effective voltage which is equal to or lower than the OFF-voltage to the non-display region. FIG. 15 shows an example construction of a liquid crystal display apparatus. The numeral 1 denotes a normally-white type liquid crystal display panel, in which a substrate on which plural scanning electrodes are formed and a substrate on which plural signal electrodes are formed are arranged to oppose each other with a several-$\mu$m gap, and a liquid crystal such as that described earlier as an example is enclosed in the gap. Electrical fields are applied to the liquid crystal in which the pixels (dots) are arranged in matrix in response to cross sections of the scanning electrodes and the signal electrodes so that display screens are formed. An example is assumed here such that 240 lines×320 columns of dots can be displayed on a full screen, in which a hatched section D of 40 lines×160 columns in the left upper section is, for example, a partial display region, and the other region is in a non-display state. Selection voltages are applied to the scanning electrodes in a selection period, ON voltages or OFF voltages (or intermediate voltages therebetween when necessary) applied to the signal electrodes crossing with the foregoing scanning electrodes are applied to the liquid crystal at the foregoing cross sections, and orientation states of molecules of the liquid crystal at these sections vary in response to the ON voltage and the OFF voltage, by which display is driven. For reference, in a non-selection period, non-selection voltages are applied to the scanning electrodes.

Next, a block 2 represents a Y driver that selectively applies the selection voltages or the non-selection voltages to the plural scanning electrodes. A block 3 represents an X driver that applies the signal voltages (ON voltages, OFF voltages, and intermediate voltages therebetween when necessary) according to the display data Dn to the signal electrodes. A driving-voltage forming circuit represented by a block 4 forms plural voltage levels necessary for driving the liquid crystal, and the plural voltage levels formed therein are fed to the X driver 3 or the Y driver 2. From the fed voltage levels, the respective drivers selects predetermined voltage levels in accordance with timing signals and display data and apply the selected voltage levels to the signal voltages and the scanning electrodes of the liquid crystal display panel 1. A block 5 represents an LCD controller that forms timing signals CLY, FRM, CLX, and LP, display data Dn, and a control signal PD which are necessary for the foregoing circuits and that is connected to a system bus of an electronic equipment including this liquid crystal display apparatus. A block 6 represents a power source arranged outside of the liquid crystal display apparatus to feed power to the liquid crystal display apparatus.

These circuit blocks of the liquid crystal display panel in this embodiment are identical to those of the first to eighth embodiments; particularly, with the simple-matrix type liquid crystal display panel, the partial display can be implemented by the same driving method as those for the first to eighth embodiments.

A description to be given below of the driving method uses an example driving method such as that has been described with reference to FIGS. 9 and 10, which selects the scanning electrode for every line. However, simultaneous selection of multilines by use of the MLS driving method may be used.

FIG. 16 shows example timing charts of the liquid crystal display apparatus in FIG. 15 in partial display state, assuming the target to be the simple-matrix type liquid crystal display panel. Dn denotes display data transferred from the controller 5 to the X driver 3, and a period in which the display data is transferred is shown by a hatched block. This hatched block part performs high-speed transfer of the display data Dn for one display line (scanning electrode) from the controller 5 to the X driver 3. CLX represents a transferring clock that performs transfer-control of the display data Dn from the controller 5 to the X driver 3. The X driver 3 includes a shift register therein and allows this shift register to operate synchronously with the clock CLX to sequentially transfer the display data Dn for one display line in this shift register and a latch circuit for a temporary period. With the RAM-built-in X driver 3 as shown in FIG. 11, the display data Dn is stored in a RAM 25.

LP denotes a data latch signal that latches the display data Dn for one line in batch from the shift register and the latch circuit into the next-stage latch circuit of the X driver 3. The numbers indicated along LP are the line (scanning line) numbers of the display data Dn transferred to the latch circuit of the X driver 3. That is, the display data Dn is transferred to the X driver 3 in advance from the controller 5 in a selection period prior to the output of the signal voltage corresponding to the display data Dn. For example, since the 40th line of the display data is latched at the 40th of LP, it is transferred in advance thereof according to the clock CLX. According to the display data Dn latched into the latch circuit, the X driver 3 outputs a voltage level selected from plural voltage levels (ON voltages, OFF voltages, and intermediate voltages therebetween when necessary) fed from the driving-voltage forming circuit 4.

CLY denotes a scanning-signal transfer clock for every one scanning-line selection period. FRM denotes a screen-scanning start signal for every one frame period. The Y driver 2 includes a shift register therein, and this shift register inputs the screen-scanning start signal FRM to itself and sequentially transfers FRM according to the clock CLY. According to this transfer, the Y driver 2 sequentially outputs the selection voltages (VS or MVS) to the scanning electrodes. The numbers given along CLY are numbers of the scanning electrodes to which the selection voltages are applied. For example, when the 40th of CLY is inputted, the Y driver 2 applies the selection voltage to the 40th line of the scanning electrode in one-CLY-cycle period. For reference, PD denotes a partial display control signal that controls the Y driver 2. In a period when this control signal PD is at the H level, the selection voltages (VS or MVS) are sequentially outputted from the Y driver 2; while in a period when the control signal PD is at the L level, the non-selection voltages (VC) are outputted to all the scanning electrodes. Such control can be easily arranged when output of the selection voltages are inhibited and a gate that turns all the outputs to the non-selection voltages is included in the Y driver 2.

For example, as the 3rd line is Y3, as the 43rd line is Y43, as the 80th column is X80, and as the 240th column is X240, the voltages to be applied are indicated in the figure. Y43 and X240 are a scanning electrode and a signal electrode, respectively, in the non-display region. For reference, all pixels of the 80th column are all arranged as ON-displays. VS and MVS represent a positive-side selection voltage and a negative-side selection voltage, respectively; VX and MVX are a positive-side signal voltage and a negative-side signal voltage, respectively; and VX and MVX are symmetrical with each other with respect to VC as the central potential, to which VX and MVX are similar. The MVX is applied to the signal electrodes of the ON-pixels of the line to which the selection voltage VS is applied, and VX is applied to the signal electrodes of the OFF-pixels. The VX is applied to the signal electrodes of the ON-pixels of the line to which the selection voltage MVS is applied, and MVX is applied to the signal electrodes of the OFF-pixels.

The PD is at the H level in a period when the 40 lines in the display region D are selected. In other periods, PD is at the L level. In the period when PD is at the H level, the Y driver 2 generates the voltage VS (MVS) that sequentially selects the first line to the fortieth line one by one to drive the scanning electrodes. For the scanning electrodes, VS output and MVS output are switched therebetween in the unit of plural scanning electrodes and line-inversion driving is performed. To scanning electrodes other than the one line selected, the non-selection voltage VC is applied. In the period when PD is at the L level, all the outputs from the Y driver 2 are at non-selection-voltage levels. Effective voltages applied to the liquid crystal of the 41st to 240th lines to which the selection voltages are not applied are considerably smaller than the effective voltages applied to the OFF-pixel liquid crystal. In this case, therefore, the 41st to 240th lines all turns to non-display states. In the selection period in the non-display region, the non-selection voltage levels are applied to the scanning electrodes; however, to the signal electrodes, there are continuously applied either predetermined voltage levels from the X driver 3 in accordance PD or voltage levels in accordance with the display data stored in the X driver 3. Nevertheless, it is preferable that in a non-display access period in the non-display region, the signal voltages are allowed to apply inverting periodically according to VC as a reference. For example, it is preferable that the polarity of the signal voltages are allowed to invert in every frame or periodically in a shorter period in the unit of a period longer than the selection period.

For reference, in this embodiment, as shown in the figure with Dn, CLX, and LP, with regard to data transfer corresponding to the non-display access period, display-data transfer to the X driver 3 is carried out for only the data to be displayed on the 1st to 40th lines, but it is suspended for the data to be displayed on the 41st to 240th lines. In the case of the matrix type liquid crystal display panel, while the X driver 3 is outputting the signal voltage corresponding to the display of a certain line, display-data transfer must be carried out for a line to be selected next; therefore, the data-transfer period precedes PD by the selection period for one scanning line.

Data transfer for 320 dots of the first line is comprised of transfer of display data for the first half of 160 dots and transfer of OFF-display data for the second half of 160 dots. Data transfer for the 2nd to 40th lines is only for the display data for the first-half 160 dots, and transfer of the OFF-data display data for the second-half 160 dots is suspended because it is not necessary. Since the X driver 3 includes a latch circuit (a storing circuit) therein to store display data for one line, the right half of the X driver 3 continues to store the OFF-display data transferred earlier even with no data transfer for the second-half 160 dots, and the right half of the X driver 3 continues to output the signal voltages to turn OFF the display. In such a manner, when display turns OFF, the effective voltages are applied to the liquid crystal for the right-half screen in the upper 40 lines.

For reference, in the aforementioned embodiment, for simplification of the description, the case of the driving method has been described, in which line-sequential driving to sequentially select the scanning electrodes one-line by one-line is adopted, and the polarity inversion cycle of the liquid-crystal driving voltages is one-frame period with the center potential VC as a non-selection voltage. However, as described earlier in the individual embodiments, the so-called MLS driving method may be used. With this method, the scanning electrodes are simultaneously selected in the unit of plural lines, such as two lines or four lines of the scanning electrodes, and sequential selection is performed on the unit basis so that the same scanning electrodes are selected in plural times within a one-frame period.

As described above, in the simple-matrix type liquid crystal display apparatus, for application of effective voltages equal to or lower than the OFF voltage to the liquid crystal in the non-display region, when the non-display region corresponds to part of scanning electrodes, non-selection voltages are always applied to the scanning electrodes in a region which is to be in the non-display state; when the non-display region corresponds to part of signal electrodes, voltages which will cause OFF display are always applied to the signal electrodes in the region that is to be in the non-display state.

TENTH EMBODIMENT

In the ninth embodiment described above, as the construction of the liquid crystal display panel 1, an active-matrix type liquid crystal display apparatus may be used, in addition to a simple-matrix construction such as that described above. In this embodiment, using an active-matrix type liquid crystal display panel for the liquid crystal display panel 1, a driving similar to that for the ninth embodiment is performed.

As the active-matrix type liquid crystal display panel, as described with reference to FIG. 22, an active-matrix type liquid crystal display panel may be used, in which a switching device formed of a two-terminal type nonlinear element, such as a thin-film diode called as an MIM, is arranged for individual pixels. In this case, either one of a scanning electrode 112 and a signal electrode 113, an element 115 connected to the foregoing, and a pixel electrode connected to the element 115 are formed on an element substrate; and the other electrode is formed on an opposing substrate; by which the two-terminal type nonlinear element 115 and a liquid crystal layer 114 are electrically connected in series between the scanning electrode 112 and the signal electrode 113. For a driving method, a selection voltage such as that shown in FIG. 16 with Y3 is applied to the scanning electrode 112 to allow the element 115 to be in a conductive state, and a signal voltage to be outputted to the signal electrode 113 is written out to the liquid crystal layer 114. When a non-selection voltage is applied to the scanning electrode 112, the element 115 turns to a non-conductive state because of increased resistance thereof to allow the voltage applied to the liquid crystal layer 114 to be retained.

Furthermore, for the liquid crystal display panel 1, an active-matrix type liquid crystal display panel that possesses transistors for the pixels, illustrated as an equivalent circuit diagram of FIG. 23, may be used. This panel is structured such that on either one (an element substrate) of paired substrates, plural scanning electrodes 112 and plural signal electrodes 113 are formed in a matrix, a switching device formed of a transistor 117 is formed for each pixel in the vicinity where the scanning electrode 112 and the signal electrode 113 cross each other, and a pixel electrode connected to the switching device is formed for each pixel. On another substrate to be arranged with a predetermined gap to oppose the foregoing substrate, a common electrode connected to a common potential 118 is arranged when it is necessary (there is a case when the common electrode is formed on the element substrate). A part between the pixel electrode and the common electrode in a liquid crystal sandwiched between the paired substrates is the liquid crystal layer 114 driven for each pixel. As well known, a gate of the transistor 117 arranged for each pixel for each pixel is connected to the scanning electrode 112, a source is connected to the signal electrode 113, and a drain is connected to the pixel electrode. They are allowed to be conductive each other according to the selection voltage applied to in a selection period, and they feed a data signal to the pixel electrode through the transistor 117. When the non-selection voltage is applied to the scanning electrode 112, the transistor 117 is turned to be non-conductive. When rise is given to necessity, the element substrate is connected to a storage capacitor connected to the pixel electrode so as to store and retain applied voltages. For reference, for the transistor 117, a thin-film transistor is used when the element substrate is an insulated substrate such as a glass substrate, and an MOS transistor is used when the element substrate is a semiconductor substrate.

In an active-matrix type liquid crystal display apparatus such as that described above, a manner of application of the effective voltage equal to or lower than the OFF-voltage to the liquid crystal for pixels positioned in the non-display region that is to be set in a display screen will be described below.

Figure 17:
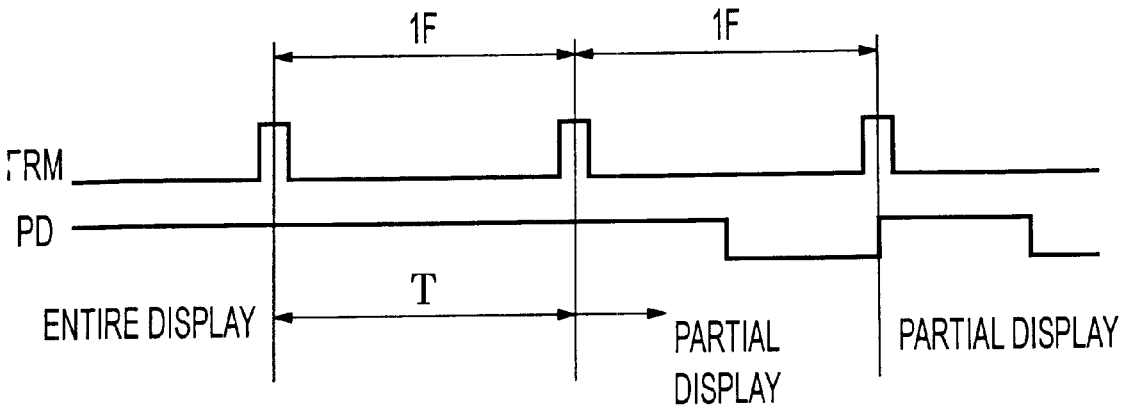
FIG. 17 is a drawing to be used to explain transition from a full-screen display state to a partial display state in the liquid crystal display apparatus in FIG. 15.
Figure 18:
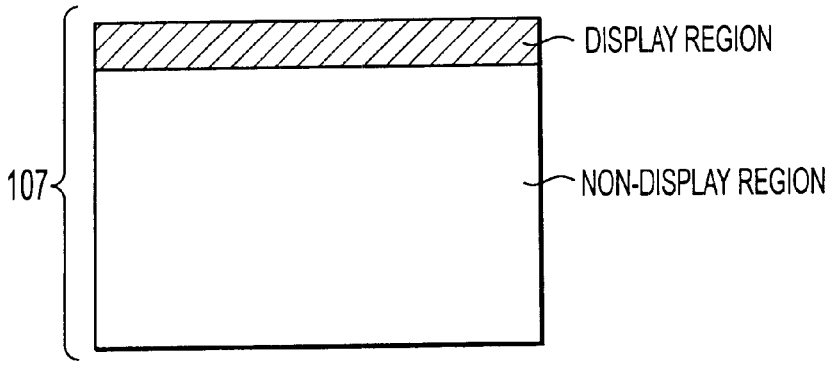
FIG. 18 PRIOR ART
FIG. 18 is a drawing to be used to explain a partial display state in a conventional liquid crystal display apparatus.
Figure 19:
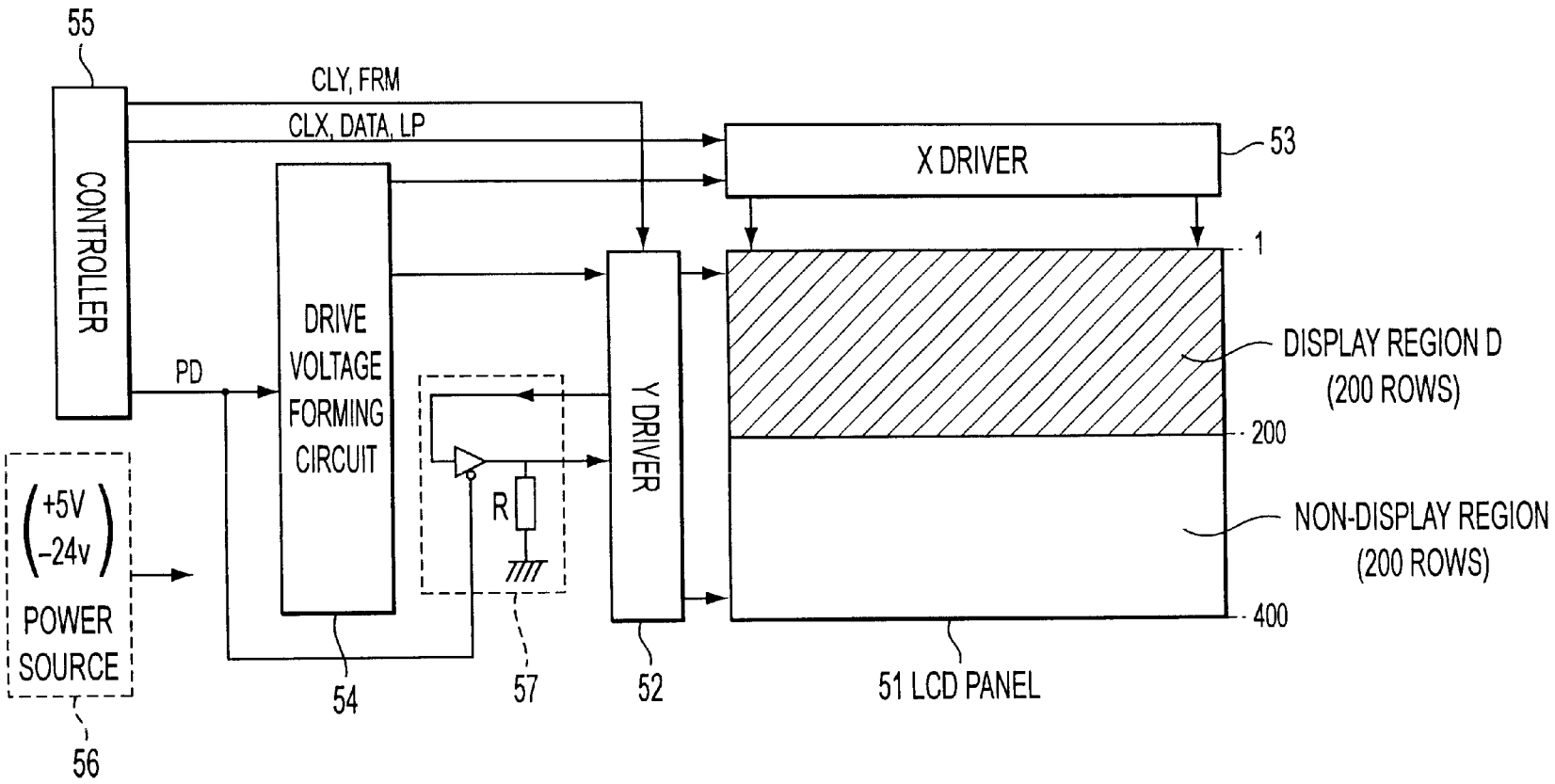
FIG. 19 PRIOR ART
FIG. 19 is a block diagram of the conventional liquid crystal display apparatus having the partial display function.

As shown in FIG. 17, it is arranged such that in a shift period when a full-screen display state is changes to a partial display state, voltages equal to or lower than the OFF-voltage are at least written out to the liquid crystal for pixels in a non-display region at least in a one-frame period (1F). That is, voltages equal to or lower than the OFF-voltage are written out to the pixels 116 that are to be in the non-display state in the first frame changed to the partial display state (the period T in the figure). In this case, as shown in the figure, the partial display control signal PD is turned to the H level even in the non-display line access period in the non-display region in the first frame, and selection voltages are applied to the scanning electrodes 112 in the non-display region so as to allow the switching devices 115 and 117 for the individual pixels to be conductive each other, by which voltages equal to or lower than the OFF-voltage can be written out to the liquid crystal layers 114 for the pixels in the non-display region.

Furthermore, an arrangement may be such as that described below. When the liquid crystal is a memory liquid crystal, it is arranged that in the period T, all the scanning electrodes are not scanned; however, the control signal PD is turned to the H level only in the non-display line access period, selection voltages are applied only to the scanning electrodes in the non-display region, sequential selection is carried out only for the scanning electrodes 112 corresponding to the non-display region to allow the switching devices to be conductive each other, and then voltages equal to or lower than the OFF-voltage are written out only to the liquid crystal layers 114 for the pixels in the non-display region. In this arrangement, in the T period, non-selection voltages are applied to the scanning electrodes 112 corresponding to the display region D, and voltages of the liquid crystal layer for the corresponding pixels are not to be rewritten.

In the following second frame and thereafter, an arrangement may be such that non-selection voltages are always applied to the scanning electrodes 112 in the non-display region to allow the switching devices 115 and 117 to be always non-conductive each other, and the voltages applied to the pixel electrodes are maintained to be the voltages as they are equal to or lower than the OFF-voltage, which are written out to the pixels 116 in the first frame (period T) that is the period when the voltages applied to the pixel electrodes are shifted to be in the partial display state. With the active-matrix type liquid crystal display panel, these steps are necessary because the individual pixels 116 continue to retain voltages applied in a selection period by using the storage capacitors.

Furthermore, as shown in FIG. 15, in the partial display state, when a non-display region (non-display region on the right of the display region D in FIG. 15) is arranged or when a non-display region is arranged only in the perpendicular direction (vertical direction) on the screen, even though selection voltages are applied to scanning electrodes, voltages equal to or lower than the OFF-voltage which are to be the OFF-displays may always be applied to the signal electrodes 113 for the region that is to be in the non-display state. By this arrangement, even though the switching devices 115 and 117 become conductive each other according to the selection voltage applied to the scanning electrode 112, voltages equal to or lower than the OFF-voltage continue to apply to the corresponding pixel electrodes to cause the non-display region.

The above manner, in which effective voltages equal to or lower than the OFF-voltage are applied to the liquid crystal for the pixels positioned in the non-display region, can be implemented by means of a simpler circuit means. Furthermore, when the partial display region D is formed in the perpendicular direction (vertical direction) on the screen, many portions of components such as the controller 5, the driving-voltage forming circuit 4, the X driver 3, and the Y driver 2, can be suspended in the non-display line access period in the partial display state. Furthermore, with the normally-white type, lower-voltage application is performed to pixels in the non-display region in OFF-display. These allow notable reduction of power consumption by the driving circuit.

Furthermore, with the normally-white type, in the case of liquid crystal such as a horizontal-orientation type, liquid crystal molecules are horizontally oriented in the non-display region. Since permittivity of liquid crystal molecules is low in the horizontal-orientation state, charging and discharging current due to the liquid crystal is reduced in the non-display region; therefore, power consumption by the entire display apparatus can be reduced notably greater than in the case of the full-screen display state.

As described above, according to the ninth to tenth embodiments, with the liquid crystal display apparatus of the reflective type or the transflective type that allows a partial display state in which only a partial region in a full screen is to be in a display state, and other region is to be in a non-display state, display that is not incompatible in the partial display state can be realized, and concurrently, notable reduction of power consumption can be realized.

For reference, the first to tenth embodiments may be applied not only to the liquid crystal display apparatus but also other electrooptical apparatuses in which scanning electrodes and signal electrodes are arranged in a matrix to form pixels. For example, they may be applied to a plasma-display panel (PDP), an electroluminescence (EL) device, and a field-emission device (FED).

EMBODIMENT OF ELECTRONIC EQUIPMENT

Figure 24:
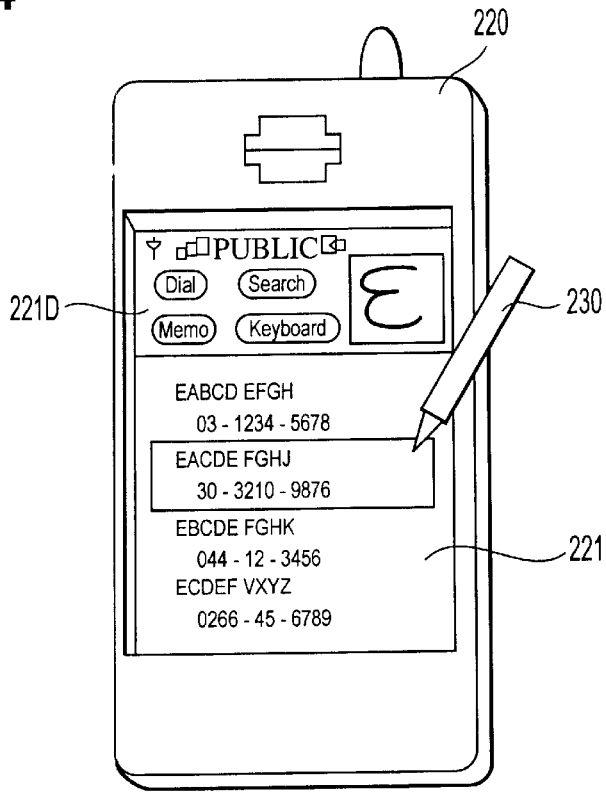
FIG. 24 shows appearance of an electronic equipment using an electrooptical apparatus and the liquid crystal display apparatus as a display apparatus of the present invention.

FIG. 24 is a drawing showing an appearance of an electronic equipment according to the present invention. The number 221 denotes an information equipment including a portable telephone function and using a battery as a power source. The number 221 denotes a display unit using either one of the matrix type electrooptical apparatus or the liquid crystal display apparatus according to the embodiments described above. In this display unit, the screen turns to a full screen state when it is necessary, as shown in the figure; however, in a wait time such as a phone-call wait time, only a display region 221D, which is part of the display unit 221, partially turns to a display status. The number 230 denotes a pen which is to be an input means. The display unit 221 having a touch panel in front thereof, while a screen are being viewed, the pen 230 is used to press the display portion to allow switch-input.

Figure 25:
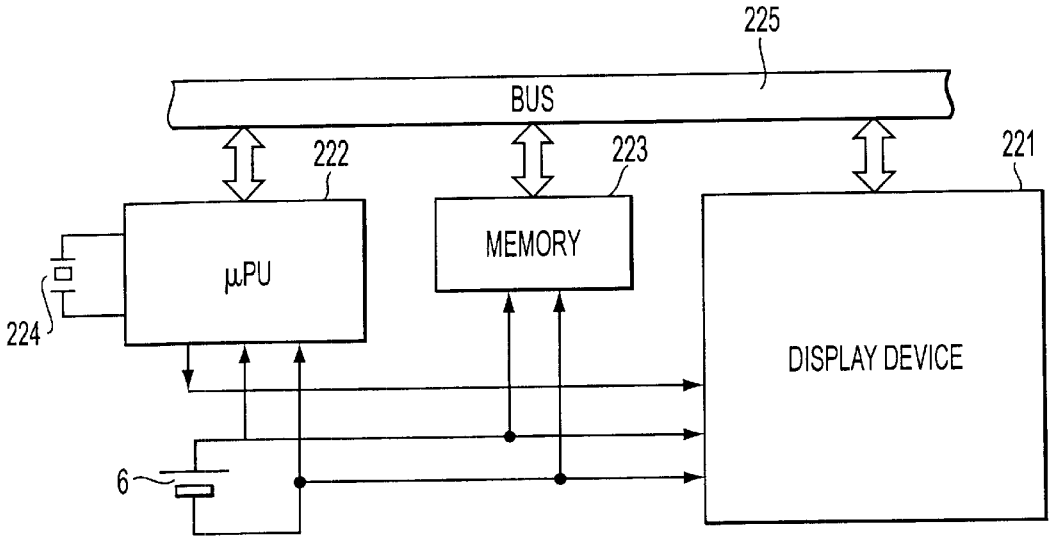
FIG. 25 is a block diagram of the electronic equipment of the present invention.

FIG. 25 is an example partial circuit diagram of the electronic equipment. The number 222 denotes $\mu$PU (a microprocessor unit) that totally controls the electronic equipment 222; 223 denotes a memory that stores various types of data, such as programs, information, and display data; and 224 denotes an liquid-crystal vibrator as a time standard source. According to the liquid-crystal vibrator 224, the $\mu$PU 222 generates operation clock signals in the electronic equipment 220 and feeds them to individual circuit blocks. The circuit blocks are connected to each other through a system bus 225, and they are also connected to other blocks such as an input/output unit. Power is fed to these circuit blocks from a battery source 6. The display unit 221 includes items such as those shown in FIG. 1, which are the liquid crystal display panel 1, the Y driver 2, the X driver 3, the driving-voltage forming circuit 4, and the controller 5. The function of the controller 5 may be concurrently covered by the $\mu$PU 222.

In this, use of the electrooptical apparatus and liquid crystal display apparatus according to the aforementioned embodiments allows a screen in the partial display state to be of an interest and an original, in addition to allowing reduction of the total power consumption by the electronic equipment.

Furthermore, an arrangement such as that described below is preferable because power consumption can be minimized to extend service life of the battery. That is, as the display unit, a reflective type display unit is used; or a transflective type display unit is used, in which although a light source for a backlight illumination of the display unit is included, display turns to be a reflective type display when the light source is not used, and the illumination light is transmitted so that display turns to be a transmissive display when the light source is used. Furthermore, with the electronic equipment of this embodiment, in a wait time after a state in which the equipment is not operated has continued longer than a constant time, the display unit turns to the partial display state to minimize power which would be consumed by the driver and the controller for driving of the display unit; therefore, the battery service life can be further extended.

INDUSTRIAL APPLICABILITY

According to the present invention, with an electronic equipment such as a portable telephone used with long standby times, mode of a display unit at the standby times is turned to a partial display state in which only necessary sections are displayed; by which the electronic equipment using less power consumption can be realized.

What is claimed is:

1. The driving method for an electrooptical apparatus, in which a plurality of scanning electrodes and a plurality of signal electrodes are arranged to cross with each other, and a partial display state occurs in which a display screen is partially displayed in a display region, the driving method comprising:

applying a selection voltage to one scanning electrode in the display region, for a first period used to select the one scanning electrode in a frame period;

applying a non-selection voltage to the one scanning electrode in a second period used to select scanning electrodes other than the one scanning electrodes in the display region in the frame period;

applying voltages similar to the non-selection voltage to the plurality of scanning electrodes in the screen for a third period other than the first period and the second period in the frame period, respectively, and applying voltages similar to each other to the plurality of signal electrodes in the screen for a predetermined period equal to or less than the third period in a polarity-inversion driving state and a full-screen display state.

2. The driving method for an electrooptical apparatus according to claim 1, the application voltages for the signal electrodes being alternately switched between a potential when an ON-display is performed and a potential when an OFF-display is performed in the fall-screen display state, every period which is at least longer than the same-polarity driving period in the polarity inversion driving state and the full-screen display state.

3. An electrooptical apparatus, comprising:

a plurality of scanning electrodes and a plurality of signal electrodes which are arranged to cross with each other, a partial display state occurring when a display screen is partially displayed as a display region;

a scanning-electrode driving circuit that applies a selection voltage to one scanning electrode in the display region, for a first period used to select the one scanning electrode in a frame period and applies a non-selection voltage to the one scanning electrode in a second period used to select scanning electrodes, other than the one scanning electrode in the display region in the frame period and applies voltages similar to the non-selection voltage to the plurality of scanning electrodes in the display screen for a third period other than the first period and the second period in the frame period respectively;

a signal-electrode driving circuit that applies voltages similar to each other to the plurality of signal electrodes in the display screen for a predetermined period equal to or less than the third period; and a control circuit that outputs a partial display control signal that controls the scanning-electrode driving circuit and the signal-electrode driving circuit, the scanning-electrode driving circuit and the signal-electrode driving circuit driving the scanning electrodes and the signal electrodes according to the partial display control signal, so that the scanning electrodes and the signal electrodes in the display region in the display screen are driven so as to cause display according to the display data and the non-selection voltages are applied continuously to the scanning electrodes in the non-selection region in the display screen, thus, causing a non-display state.

4. The electrooptical apparatus according to claim 3, the electrooptical apparatus being a passive-matrix liquid crystal display apparatus.

5. The electrooptical apparatus according to claim 3 the electrooptical apparatus being an active-matrix liquid crystal display apparatus.

6. Electronic equipment comprising:

the electrooptical apparatus of claim 3.

7. A driving circuit for an electrooptical apparatus, in which a plurality of scanning electrodes and a plurality of signal electrodes are arranged to cross with each other, and a partial display state occurs in which a display screen is partially displayed as a display region, comprising:

a first driving circuit that applies voltages to the plurality of scanning electrodes; and a second driving circuit comprising:

a storing circuit that stores display data, the second driving circuit applying voltages selected according to the display data read from the storing circuit to the plurality of signal electrodes, the first driving circuit applies, a selection voltage to one scanning electrode in the display region, for a first period used to select the one scanning electrode in a frame period and applies a non-selection voltage to the one scanning electrode in a second period used to select scanning electrodes, other than the one scanning electrode in the display region in the frame period and applies voltages similar to the non-selection voltage to the plurality of scanning electrodes in the display screen for a third period other than the first period and the second period in the frame period respectively and the second driving circuit reading the display data from the storing circuit in a period corresponding to the selection period for the scanning electrodes in the display region and fixing an address for reading the display data from the storing circuit in other periods.

8. The driving circuit for an electrooptical apparatus according to claim 7, a shift register in the first driving circuit, the shift register stopping shift operations in a period other than the selection period.

9. An electrooptical apparatus, comprising:

the driving circuit of claim 7; and scanning electrodes and signal electrodes to be driven by the driving circuit.

10. The electrooptical apparatus according to claim 9, further comprising:

a driving-voltage forming circuit that forms application voltages for the scanning electrodes or the signal electrodes to supply application voltages to the first and second driving circuits, the driving-voltage forming circuit including a contrast adjustment circuit for adjusting the application voltage, the operations of the contrast adjustment circuit stopping in a period other than the period of selection of the scanning electrodes in the display region.

11. A driving circuit for an electrooptical apparatus, in which a plurality of scanning electrodes and a plurality of signal electrodes are arranged to cross with each other, and a partial display state occurs in which a display screen is partially displayed as a display region, comprising:

a scanning-electrode driving circuit that applies selection voltages sequentially to the plurality of scanning electrodes according to shift operations by a shift register, the scanning-electrode driving circuit applies a selection voltage to one scanning electrode in the display region of the display screen according to shift operations by the shift register, for a first period used to select the one scanning electrode in a frame period and applies a non-selection voltage to the one scanning electrode in a second period used to select scanning electrodes, other than the one scanning electrodes in the display region in the frame period and applies voltages similar to the non-selection voltage to the plurality of scanning electrodes in the display screen for a third period other than the first period and the second period in the frame period respectively, wherein the scanning-electrode driving circuit applies voltage similar to non-selection voltage by stopping shift operation by the shift register, and the scanning-electrode driving circuit comprising:

an initial setting circuit that resets the shift register to an initial state when the display screen changes from a partial-screen state to a full-screen display state.

12. An electrooptical apparatus in which a plurality of scanning electrodes and a plurality of signal electrodes are arranged to cross with each other, and a partial display state occurs in which a display screen is partially displayed as a display region, comprising:

a first driving circuit that applies voltages to the plurality of scanning electrodes; and a second driving circuit comprising:

a storing circuit that stores display data, and the second driving circuit applying voltages selected according to the display data read from the storing circuit to the plurality of signal electrodes, the first driving circuit applies a selection voltage to one scanning electrode in the display region, for a first period used to select the one scanning electrode in a frame period and applies a non-selection voltage to the one scanning electrode in a second period used to select scanning electrodes, other than the one scanning electrodes in the display region in the frame period and applies voltages similar to the non-selection voltage to the plurality of scanning electrodes in the display screen for a third period other than the first period and the second period in the frame period respectively, and the second driving circuit applying voltages to the plurality of signal electrodes in a selection period of the scanning electrodes of the display region on the basis of display data read from the storing circuit and applying voltages to the plurality of signal electrodes in the other period on the basis of the same display data.

13. The electrooptical apparatus according to claim 12, the second driving circuit alternately changing, in a period other than the selection period for scanning electrodes in the display region, the application voltages for the signal electrodes between a potential when an ON-display is performed and a potential when an OFF-display is performed in a full-screen display state, every of period which is at least longer than a same-polarity driving period in a polarity inversion driving state and the full-screen display state.

14. A method for displaying for a frame period in a display region that is a partial region of a screen in a display apparatus, the screen including a plurality of electrooptical elements each disposed between a plurality of scanning lines and a plurality of signal lines, the method comprising:

applying a selection voltage to one scanning line in the display region, for a first period used to select the one scanning line in a frame period;

applying a non-selection voltage to the one scanning line in a second period used to select scanning lines other than the one scanning line in the display region in the frame period;

applying voltages similar to the non-selection voltage to the plurality of scanning lines in the screen for a third period other than the first period and the second period in the frame period, respectively, and applying voltages similar to each other to the plurality of signal lines in the screen for a predetermined period equal to or less than the third period.

15. The display method for a display apparatus according to claim 14, the voltages being applied to the scanning lines in the period when the voltages applied to all the scanning lines are fixed are to be the non-selection voltages.

16. The display method for a display apparatus according to claim 15, the non-selection voltages being one level.

17. The display method for a display apparatus according to claim 14, a driving-voltage forming circuit for forming driving voltages to be applied to the scanning lines and the signal lines, stopping the driving-voltage forming circuit operation in the period when individual application voltages for all the scanning lines and all the signal lines are fixed.

18. The display method for a display apparatus according to claim 17, the driving-voltage forming circuit comprising a charge-pump circuit that switches among a plurality of capacitor connections according to clocks to generate boosted voltages and dropped voltages, and operation of the charge-pump circuit being stopped in the period when individual application voltages for all the scanning lines and all the signal lines are fixed.

19. The display method for a display apparatus according to claim 14, a first display mode causing the full portion of the display screen to be in a display state and a second display mode causing one partial region of the display screen to be in a display state and the other to be a non-display region, and the length of the period when the selection voltages being applied to individual scanning lines in the display region not changing for the first display mode and the second display mode.

20. The display method for a display apparatus according to claim 19, the potentials to be applied to the signal lines in a period other than a selection period for the scanning lines in the display region being set so that effective voltages to be applied to a liquid crystal for pixels in the display region in the display state are the same in the first display mode and the second display mode.

21. The display method for a display apparatus according to claim 20, the potentials to be applied to the signal lines in the period other than the selection period for the scanning lines in the display region being set so as to be the same as the application voltages for the signal lines in the case of an ON-display or an OFF-display in the first display mode.

22. The display method for a display apparatus according to claim 21, the plurality of scanning lines being simultaneously selected in a unit of the predetermined number and are sequentially selected on the basis of the predetermined number of units, and the application voltages for the signal lines in the case of the ON-display or the OFF-display in the second display mode being set so as to be the same as the application voltages for the signal lines in the case of full-screen ON-display or full-screen OFF-display in the first display mode.

23. The display method for a display apparatus according to claim 19, the polarity of the voltage difference between the scanning lines and the signal lines being inverted in every frame in the period other than the selection period for the scanning lines in the display region in the second display mode.

24. The display method for a display apparatus according to claim 14, the potentials to be applied to the signal lines in a period other than a selection period for the scanning lines in the display region being set by alternately switching every predetermined period for one-screen scanning, between the application potential when the ON-display is performed and the application potential when the OFF-display is performed in the full screen display state.

25. The display method for a display apparatus according to claim 14, the display apparatus being a passive-matrix liquid crystal display apparatus.

26. The display method for a display apparatus according to claim 14, the display apparatus being an active-matrix liquid crystal display apparatus.

27. A display apparatus driven by the display method as claimed in claim 14.

28. The method as set forth in claim 14, wherein the display apparatus is an active-matrix type, the method further comprising:

in a transition from displaying in the whole region of the screen to displaying in the partial region thereof, applying the selection voltage to a scanning line for one electrooptical element of the plurality of electrooptical elements in a region that should be a non-display region in the screen; and applying a non-selection voltage to a signal line for the one electrooptical element.

29. A driving circuit for displaying for a frame period in a display region that is a partial region of a screen in a display apparatus, the screen including a plurality of electrooptical elements each disposed between a plurality of scanning lines and a plurality of signals lines, the driving circuit comprising:

a scanning line driving device that applies a selection voltage to one scanning line in the display region, for a first period used to select the one scanning line in a frame period, and applies a non-selection voltage to the one scanning line in a second period used to select scanning lines other than the one scanning line in the display region in the frame period, and the scanning line driving device further applies voltages similar to the non-selection voltage to the plurality of scanning lines in the screen for a third period other than the first period and the second period in the frame period, respectively, and applies voltages similar to each other to the plurality of signal lines in the screen for a predetermined period equal to or less than the third period.

30. An electrooptical apparatus for displaying for a frame period in a display region that is a partial region of a screen in a display apparatus, the electrooptical apparatus comprising:

a scanning line driving device that applies a selection voltage to one scanning line in the display region, for a first period used to select the one scanning line in a frame period, and applies a non-selection voltage to the one scanning line in a second period used to select scanning lines other than the one scanning line in the display region in the frame period, and the scanning line driving device further applies voltages similar to the non-selection voltage to the plurality of scanning lines in the screen for a third period other than the first period and the second period in the frame period, respectively, and applies voltages similar to each other to the plurality of signal lines in the screen for a predetermined period equal to or less than the third period.

* * * * *